US006793308B2

(12) United States Patent
Sugimoto et al.

(10) Patent No.: US 6,793,308 B2
(45) Date of Patent: Sep. 21, 2004

(54) INK-JET RECORDING APPARATUS AND INK-JET RECORDING METHOD USING INKS OF DIFFERENT DENSITIES, AND RECORDED ARTICLES

(75) Inventors: Hitoshi Sugimoto, Yokohama (JP); Yuji Akiyama, Yokohama (JP); Miyuki Matsubara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 213 days.

(21) Appl. No.: 08/811,234

(22) Filed: Mar. 3, 1997

(65) Prior Publication Data

US 2002/0054178 A1 May 9, 2002

Related U.S. Application Data

(63) Continuation of application No. 08/248,513, filed on May 24, 1994, now abandoned.

(30) Foreign Application Priority Data

May 24, 1993 (JP) ..... 5-121480
Jun. 28, 1993 (JP) ..... 5-157582

(51) Int. Cl.[7] ..... B41J 2/205
(52) U.S. Cl. ..... 347/15; 347/43; 347/85; 347/86
(58) Field of Search ..... 347/100, 43, 15, 347/85, 86; 106/20 D

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/57 |
| 4,459,600 A | | 7/1984 | Sato et al. | 347/56 |
| 4,463,359 A | | 7/1984 | Ayata et al. | 347/57 |
| 4,551,736 A | * | 11/1985 | Suzuki | 347/100 |
| 4,558,333 A | | 12/1985 | Sugitani et al. | 347/65 |
| 4,611,219 A | * | 9/1986 | Sugitani | 347/43 |
| 4,723,129 A | | 2/1988 | Endo et al. | 347/56 |
| 4,739,847 A | * | 4/1988 | Terasawa | 177/140 |
| 4,740,796 A | | 4/1988 | Endo et al. | 347/56 |
| 4,855,762 A | * | 8/1989 | Suzuki | 347/86 |
| 4,860,026 A | * | 8/1989 | Matsumoto | 347/15 |
| 4,952,942 A | * | 8/1990 | Kanome et al. | 347/15 |
| 5,245,362 A | * | 9/1993 | Iwata | 347/23 |
| 5,382,283 A | * | 1/1995 | Yui | 106/20 D |
| 5,477,248 A | * | 12/1995 | Sugimoto | 347/100 |
| 5,623,294 A | * | 4/1997 | Takizawa et al. | 347/98 |
| 5,734,403 A | * | 3/1998 | Suga et al. | 347/101 |
| 6,027,196 A | * | 2/2000 | Gotoh et al. | 347/7 |

FOREIGN PATENT DOCUMENTS

| | | | | |
|---|---|---|---|---|
| JP | 54-56847 | | 5/1979 | B41M/5/26 |
| JP | 59123670 | | 7/1984 | B41J/3/04 |
| JP | 59138461 | | 8/1984 | B41J/3/04 |
| JP | 60-71260 | | 4/1985 | B41J/3/04 |
| JP | 1-242256 | * | 9/1989 | B41J/3/04 |

* cited by examiner

*Primary Examiner*—Hai Pham
*Assistant Examiner*—Lam S Nguyen
(74) *Attorney, Agent, or Firm*—Fitzpatrick, Cella, Harper & Scinto

(57) ABSTRACT

An ink-jet recording apparatus and an ink-jet recording method which provide an image featuring reduced graininess and good gradation.

A plurality of inks of different densities are used to obtain a halftone image with controlled graininess. An ink which has low penetrability on a recording medium and which controls the diffusion of dots is used as an ink with a relatively high density. An ink which has high penetrability and which permits easy diffusion of dots is used as an ink with a relatively low density. The present invention also provides a characteristic recorded article to be formed by a plurality of dots having different penetrabilities on a recording medium.

Among a plurality of inks with different densities, the inks of the same color category are grouped and held in an ink container and are divided in the container by the ink density. This configuration makes it possible to make the containers smaller and minimize the number of containers.

71 Claims, 28 Drawing Sheets

INK-JET RECORDING APPARATUS AND INK-JET RECORDING METHOD USING INKS OF DIFFERENT DENSITIES, AND RECORDED ARTICLES

This application is a continuation of application Ser. No. 08/248,513, filed on May 24, 1994 now abandoned.

BACKGROUND OF THE INVENTION

1. Field of the Invention

The present invention relates to an ink-jet recording apparatus and a recording method, whereby a plurality of types of inks, which belong to the same color group but have different dye densities, are discharged onto a recording medium to perform recording, and resulting recorded articles.

2. Related Background Art

In the conventional ink-jet recording method, ink is discharged from a plurality of ink discharge ports, which are formed in a recording head, in accordance with data signals and the ink droplets are caused to adhere to a material to be recorded on such as paper. This recording method is employed for a printer, facsimile, and copier, for example.

In the aforesaid apparatus, there are methods available, including one using an electrothermal energy converter, wherein a heating device (electrothermal energy transducer) is provided, as a discharging means for discharging ink, in the vicinity of a discharge port, and an electrical signal is applied to the heating device to heat the ink locally to cause pressure change, thereby discharging the ink through the discharge port, and another method wherein an electromechanical transducer such as a piezoelectric device.

In this type of recording method, the recording control for medium tone according to a dot density control method, wherein the number of recording dots per unit area is controlled by a recording dot of a fixed size in order to represent the medium tone, or a dot diameter control method, wherein the size of the recording dot is controlled to represent the medium tone is carried out.

The latter dot diameter control method has restrictions because it requires complicated control; therefore, the former dot density control method is commonly used.

Further, the use of the electrothermal energy converter, which can be manufactured more easily and which permits higher density and accordingly higher resolution, as the ink discharging means, makes it difficult to control a pressure variation and also makes it impossible to change the diameter of the recording dot. For this reason, the dot density control method is used.

There is a systematic dither method as one of the typical binary techniques for representing medium tone used for the dot density control method, however, this method is disadvantageous in that the number of gradation levels is limited by a matrix size. To be specific, to increase the number of gradation levels, it is necessary to increase the matrix size, but increasing the matrix size causes a picture element of a recorded image comprised of a single matrix to grow larger with resultant lower resolution, thus posing problems. There is a conditioned decisive dither method such as an error diffusion method as another typical binary technique. This is a method, wherein a threshold value is changed, considering a peripheral picture element of an input picture element, while the aforesaid systematic dither method is an independent decisive dither method, wherein a threshold value, which is independent of an input picture element, is used for binarizing. The conditioned decisive dither method represented by this error diffusion method provides such advantages as good compatibility of gradation performance and resolution and minimized chances of a moire pattern occurring in a recorded image when an original image is a printed image, however, it also presented a problem in that grainy look in a lighter part of an image is more noticeable, leading to lower rating of the image quality. This problem was especially marked in a recording apparatus with a lower recording density.

To make the grainy look less conspicuous, a recording method has been proposed, wherein the conventional ink-jet recording apparatus is provided with two recording heads which discharge an ink of a low density or low dye density and an ink of a high density or high dye density; recording dots are formed with the ink of the low dye density for the light to medium tone parts of the image and the recording dots are formed with the ink of the high dye density for the medium to dark parts. When the inks of different dye densities is used, the density of the recorded image increases (the image becomes darker) as the dye density increases (becomes higher).

The use of a dark/light multi-value recording method, wherein a plurality of dark and light inks with different densities are used for a single color, improves the gradation of a highlighted part simply by upgrading from binary to ternary and decreases the dot graininess, resulting in a higher image quality. This is achieved by embedding the ink of a lower density (lighter) for the highlighted part, thereby eliminating the noise of a single dot.

This dark/light multi-value recording method, however, however, permits the elimination of the graininess by increasing the number of dye density levels of the dark and light inks. On the other hand, increasing the number of the density levels unavoidably increases the number of recording heads and ink tanks and also the size of a carriage carrying them, leading to an increased size of the whole apparatus. There are also limitation on the available number of different dark and light inks, two to four at the most. These restrictions are more marked especially in a color recording apparatus, and posed problems such as the impossibility of satisfactory reduction in the graininess in a highlighted part even when the method described above is used, and the reproduced gradation of an area, where the light ink is taken over by the dark ink, cannot be rendered linear when there is a significant difference in dot density between the dark and light color inks.

The following illustrates more problems which the applicant is aware of.

FIG. 36 shows a configuration diagram of a major section of the conventional color ink-jet recording apparatus of a serial print type which uses dark and light inks. Installed on a carriage with predetermined intervals are a recording head Kk, which discharges a dark black ink, a recording head Ku, which discharges a light black ink, a recording head Ck, which discharges a dark cyan ink, a recording head Cu, which discharges a light cyan ink, a recording head Mk, which discharges a dark magenta ink, a recording head Mu, which discharges a light magenta ink, a recording head Yk, which discharges a dark yellow ink, and a recording head Yu, which discharges a light yellow ink.

The inks for the individual recording heads are supplied from ink cartridges 12 corresponding to the individual colors. Further, the control signals to the recording heads are supplied via a flexible cable.

A material to be recorded on consisting of paper or a plastic thin plate is held by delivery rollers 21 via carrying rollers (not shown) and carried in the direction of the arrow as a carrying motor, which is not shown, runs. A carriage 23 is guided and supported by a guide shaft 22 and an encoder (not shown). The carriage is also shuttled by a carriage motor 25 along the guide shaft 22 mentioned above.

A heating device (electrothermal energy converter), which generates heat energy for discharging an ink is provided inside (liquid passage) the ink discharge port of the ink-jet unit described above. An image can be formed by driving the heating device in accordance with recording signals and the reading timing of the encoder to jet and deposit ink droplets onto a material to be recorded on in the order of the dark black, light black, dark cyan, light cyan, dark magenta, light magenta, dark yellow, and light yellow. A restoring unit with caps 26 is disposed in a home position HP of the carriage, which is selected and located outside a recording area, to maintain ink discharge stability.

The ink-jet recording apparatus, which employed dark and light inks as discussed above, however, requires that dark and light inks be prepared for each color. For example, if four colors are used, then at least eight different inks and ink cartridges must be prepared. In other words, there is a disadvantage in that a user must always keep eight different ink tanks. Accordingly, the apparatus itself unavoidably grows larger with complicated and troublesome change of the cartridges.

Furthermore, if there is a significant difference in dot density between the dark and light color inks, then the reproduced gradation cannot be rendered linear min the area where a light ink is taken over by a dark ink, frequently producing a pseudo-contour, or a change in graininess or tone of a recorded image takes place in an ink switching area, resulting in an unnatural image. To solve these problems, it is more desirable to increase the number of inks by using, for instance, low-density inks, medium-density inks, and high-density inks to perform the recording, however, this is difficult to carry out especially in a color recording apparatus because of the problems described above.

SUMMARY OF THE INVENTION

The present invention has been achieved in view of the problems discussed above, and it is an object thereof to provide an ink-jet recording apparatus and an ink-jet recording method which enable satisfactorily controlled graininess even with a fewer types of dark and light inks and permits recording with excellent gradation, and recorded articles.

The present invention for fulfilling the object mentioned above is an ink-jet recording apparatus, which forms an image by discharging inks on a recording medium by using a plurality of ink discharging means which are capable of discharging a plurality of inks with different densities, at least two of the ink discharging means discharging inks which differ in density and penetrability.

Further, according to the present invention, an ink-jet recording method is provided, wherein a plurality of inks with different densities are deposited on a recording medium to form an image, the image being formed by depositing inks on the recording medium, the inks having different densities and penetrability on the recording medium.

Still further, according to the present invention, a recorded article is provided, wherein an image has been formed on a recording medium by using a plurality of inks which differ in density and penetrability on a recording medium.

According to the present invention of the configuration described above, an image is formed by depositing inks, which differ in density and penetrability on a recording medium. This produces an image which is free of graininess and which exhibits good gradation.

It is another object of the present invention to solve the problems with the conventional apparatus described above and provide a small, inexpensive apparatus which features excellent gradation and resolution and which is capable of producing an image with an extremely good graininess, to minimize the number of the ink cartridges for supplying ink to the ink discharge means, and to permit easier operation.

To fulfill the above object, the ink-jet recording apparatus according to the present invention uses inks of at least two types of coloring materials, the ink of each coloring material being classified so that it has at least two different coloring material densities, has a plurality of ink discharge means for forming dots on a material to be recorded on by discharging the inks from the different ink discharge ports, which correspond to the plural inks, and controls the number of recording dots per unit area, which are discharged onto the material to be recorded on in accordance with an image signal, thereby permitting gradational recording, the ink cartridges, which hold the inks to be supplied to the ink discharge means, being grouped by the ink of the same type of coloring material.

Further, the ink-jet recording apparatus according to the present invention uses inks of different densities, has an ink discharge means, which discharges inks with different densities through different ink discharge ports corresponding to the inks of the plural densities to form dots on a material to be recorded on, and controls the number of recording dots per unit area in accordance with an image signal, thereby permitting gradational recording, the ink capacity of a cartridge, which supplies the ink to the ink discharge means, being different according to the predicted volume to be use of each ink.

The tanks holding inks, which are of the coloring materials of the same color but are different in density, are integrated into a single ink cartridge. Therefore, the ink cartridge can be replaced by each type of color. In addition, the capacities of the ink tanks are determined in accordance with the predicted volume of use of each ink; therefore, it is possible to prevent any ink tank from becoming empty earlier than others even when a plurality of ink tanks are combined to form the ink cartridge.

DETAILED DESCRIPTION OF THE PREFERRED EMBODIMENTS

The embodiments which apply the present inventions will now be described with reference to the drawings.

(First Embodiment)

Figure 1:
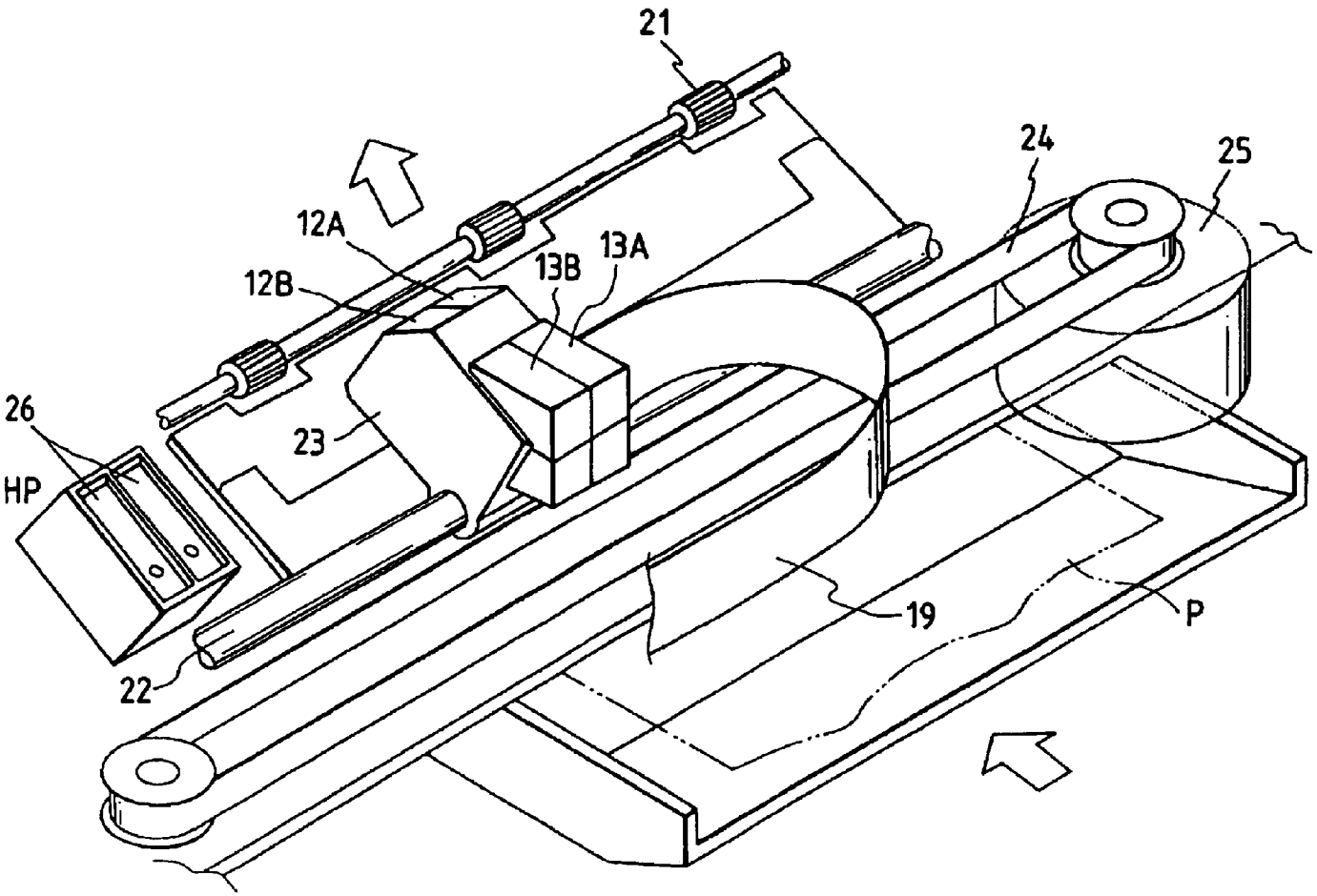
FIG. 1 is a schematic explanatory drawing of an ink-jet recording apparatus according to the present invention.

FIG. 1 is the perspective view which shows the configuration of the major section of the color ink-jet recording apparatus in the first embodiment of the present invention.

A recording head 12A, which has the discharge port trains discharging an ink of a high density (hereinafter referred to as "thick ink"), and a recording head 12B, which has the discharge port trains discharging an ink of a low density (hereinafter referred to as "thin ink"), are installed on a carriage 23 with a specified distance between them.

A material to be recorded on P consisting of paper, a plastic thin plate or the like is held by delivery rollers 21 via delivery roller (not shown), and it is fed in the direction of the arrow as a delivery motor, which is not shown, is driven.

A guide shaft 22 and an encoder (not shown) guide and support the carriage 23.

Control signals or the like to the recording heads are sent through a flexible cable 19.

The carriage 23 is shuttled along the guide shaft 22 mentioned above by a carriage motor 25 via a drive belt 24.

Provided inside (liquid passage) of the ink discharge ports of the recording heads are a heat generating device (electrothermal energy transducer) which generates heat energy for discharge the ink.

An image can be formed by driving the heat generating device in accordance with a recording signal and the reading timing of the encoder (not shown), and by jetting and depositing the ink droplets onto the material to be recorded on P in the sequence of the thick ink color and the thin ink color.

A restoring unit, which has a cap unit 26, is disposed in the home position (HP) of the carriage, the home position being selected outside the recording area. When recording is not performed, the carriage 23 is moved to the home position (HP) and the ink discharge port surface of the corresponding recording head is tightly sealed by a cap of the cap unit 26, thus preventing clogging caused by adhering ink due to an evaporated or dried ink solvent or by adhering foreign matters such as dust.

Further, to prevent defective discharge or clogging of the ink discharge ports, which are less frequently used, the capping function of the cap section is used for a standby discharge mode, wherein the ink is discharged to the cap unit 26 away from the ink discharge ports, or for restoring the discharge of an ink discharge port, which has developed a discharge failure, by operating a pump, which is not illustrated, with the cap closed in order to suction the ink from the ink discharge port. Furthermore, the ink discharge port surface can be cleaned by disposing a blade or wiping component near the cap unit.

Figure 2:
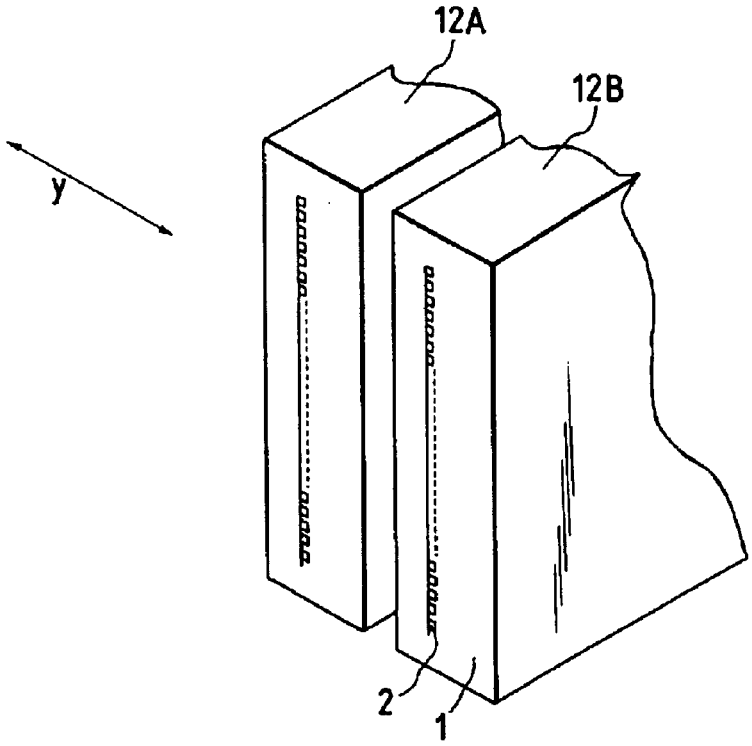
FIG. 2 is a schematic partial perspective view of the area near the discharge port of a recording head.
Figure 3:
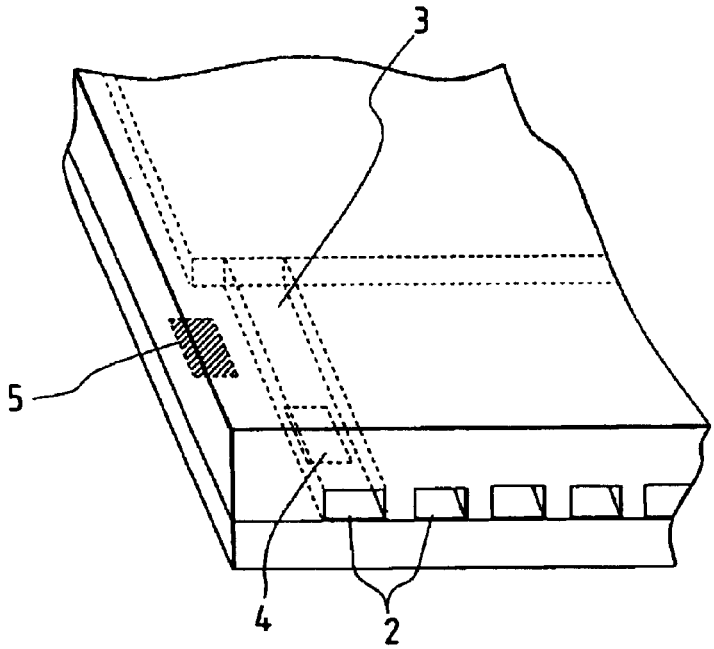
FIG. 3 is a partial perspective view which schematically shows the structure of the ink discharge section of the recording head.

FIG. 2 is the schematic perspective view of the ink discharge port trains of the recording head 12 observed from the side of the material to be recorded on; the recording head 12 is moved in the scanning direction denoted by y in the drawing. FIG. 3 is a partial perspective view which schematically shows the structure of the ink discharge unit. This shows the thick ink head 12A and the thin ink head 12B arranged in parallel, each recording head having a discharge port surface 1, which has a plurality of open discharge ports 2, and a discharge energy generating device 4 for generating the energy, which is required to discharge the ink to a liquid passage section 3 communicated with the discharge port 2, is disposed. The arrow y in FIG. 2 shows the scanning direction of the carriage 23. A reference numeral 5 of FIG. 3 is a sensor for detecting the temperature of the recording heads. In this embodiment, the diode sensors 5 are provided on both ends of the discharge port trains. There is no particular limitation to the temperature detecting means; other sensors such as thermistors may be used, and further, a method, whereby the head temperature is calculated from the duty of a printed dot may be used.

Figure 4:
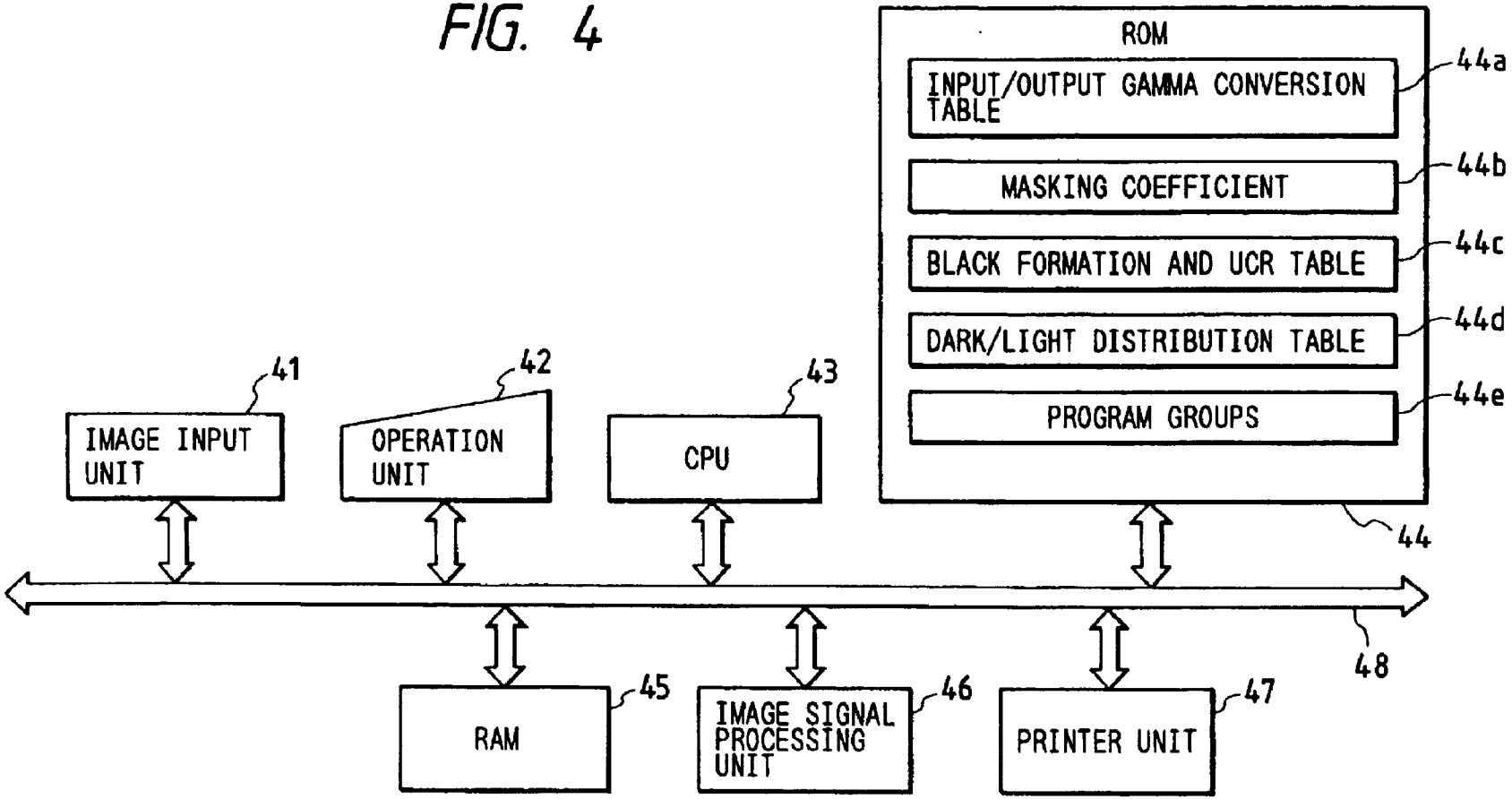
FIG. 4 is a block diagram which shows the configuration of the ink-jet recording apparatus.

FIG. 4 is the block diagram which shows the configuration of the color ink-jet recording apparatus in the embodiment.

In FIG. 4, 41 denotes an image input unit which optically reads an original image by CCD or the like, or receives an image luminance signal (RGB) from a host computer or video equipment, and 42 denotes a control unit provided with various keys for setting diverse parameters and instructing print start. A reference numeral 43 indicates a CPU which controls the whole recording apparatus in accordance with various programs in a ROM. A reference numeral 44 indicates a ROM which stores primarily the program for operating the recording apparatus in accordance with a control program and an error processing program. In this ROM, 44*a* indicates an input gamma conversion table, which is referred to for the processing in an input gamma conversion circuit, 44*b* indicates a masking coefficient, which is referred to for the processing in a color correction (masking) circuit, 44*c* indicates a black generating and UCR table, which is referred to for generating black and the processing in a UCR circuit, 44*d* indicates a dark/light distribution table, which is referred to for the processing in the dark/light distribution circuit to be discussed later, and 44*e* indicates a program group which stores the diverse programs mentioned above. A reference numeral 45 denotes a RAM which is used as a work area of various programs in the ROM and as a temporary save area for processing an error. Further, 46 denotes a processing unit which performs the image signal processing to be discussed later, and 47 denotes the printer unit which forms a dot image in accordance with the image signal which has been processed by the image signal processing unit during recording. A reference numeral 48 shows a bus line which transmits address signals, data, control signals, etc. in the apparatus.

The image signal processing unit will now be described.

Figure 5:
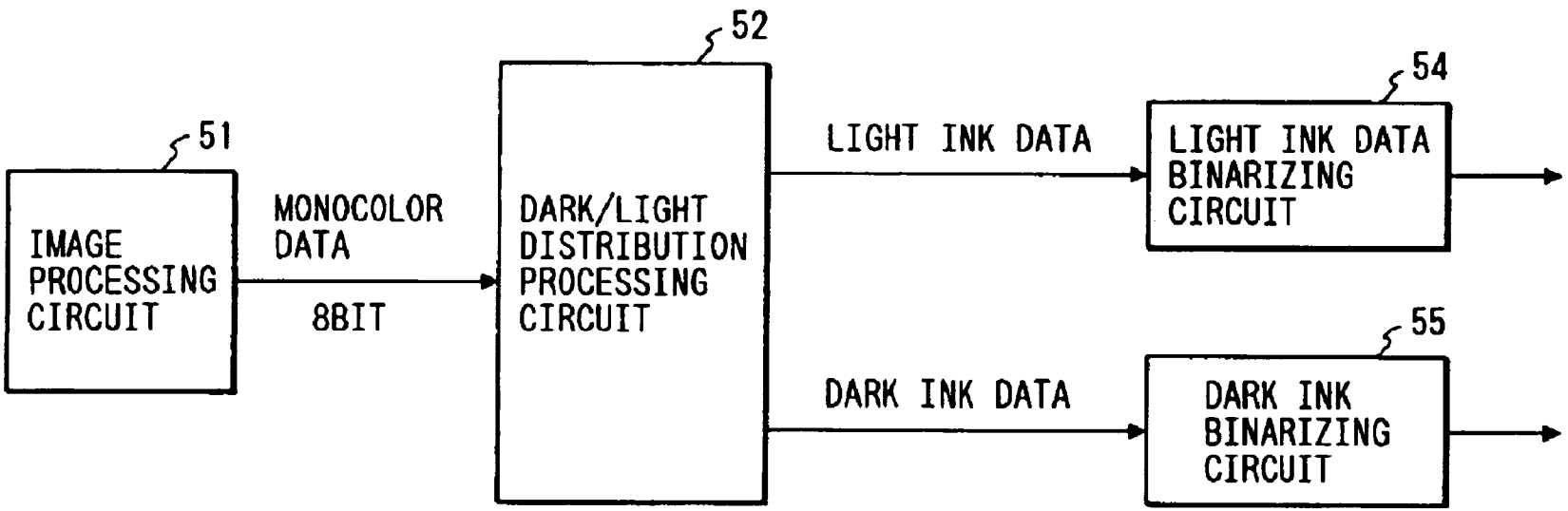
FIG. 5 is a block diagram of an image signal processing unit.

FIG. 5 shows the block diagram of the image signal processing system. The image processing circuit 51 mainly involves masking and UCR (Under Color Removal) processing, and it is compatible with all general image processing flows.

The monocolor data after color processing are taken into a subsequent dark/light distribution processing circuit 52 wherein the received data are distributed into the thin ink data and the thick ink data according to the dark/light distribution table 44*d* previously mentioned.

Figure 6:
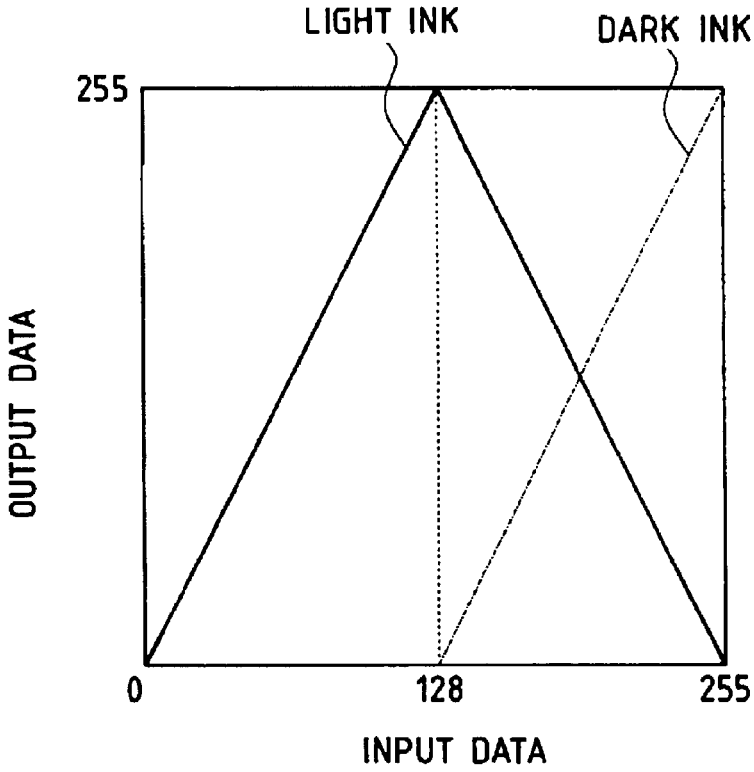
FIG. 6 is an example of a conversion graph of a dark/light distribution table.

An example of the conversion graph of the dark/light distribution table is shown in FIG. 6. The solid line corresponds to the light ink data, while the broken line with a single dot corresponds to the dark ink data; if the value of 8-bit monocolor data is within a range of 0 to 128, then the dark ink data is output as "0" and the light ink data is output within a range of "0 to 255"; if the value of the monocolor data is within a range of 128 to 255, then the dark ink data are output, corresponding to "0 to 255" while the light ink data are output, corresponding to "255 to 0". In short, in this embodiment, when input data are lower values (in the case of a highlighted image), the ink with a lower dye density (thin ink) is mainly used, while, when input data are higher values, the ink with a higher dye density (thick ink) is used for recording.

In the case of the ink-jet ink, it is possible to change the dot diffusion at the moment the ink droplets, which are discharged onto general paper such as a copy paper or bond paper, hit the paper, by changing the solvent composition of the ink.

In general, the density of a dot with less diffusion is high and the dot is suited for producing a sharp image, however, it is apt to be slow in the penetration into the paper. In contrast to this type of dot, the dot with more diffusion has a lower dot density because the color matter thereof diffuses, making the dot suitable for producing a halftone image because it forms a blurred image as a whole.

The following shows an example of the ink composition used for this embodiment:

| Composition I (Example of the ink composition with low dot diffusion) | |
|---|---|
| Dye | 0.5 to 5 wt % |
| Glycerine | 7.5 wt % |
| Thiodiglycol | 7.5 wt % |
| Urea | 7.5 wt % |
| Pure water | Remainder |

This type of ink exhibits good character quality on the general paper, including the copy paper and the bond paper. Generally, in the case of the ink-jet ink, it is said that the penetrability into paper grows faster as the value of $\eta/(\gamma\cos\theta)$ grows smaller, where $\eta$ is the viscosity of the ink, $\gamma$ is the surface tension of the ink, and $\theta$ is the angle of contact between the ink and the paper. In general, decreasing the contact angle leads to increased wettability of the ink with respect to the paper and therefore the penetrability into the paper quickens, while on the other hand, the ink tends to spread more easily on the paper surface and the resulting dots show poor sharpness, deteriorating the print quality. Decreasing the wettability with respect to paper in the attempt to improve the print quality sacrifices the penetrability. The ink having the composition shown above has a surface tension of 40 to 50 dyne/cm, which belongs to an ink group of high surface tension, but the penetrability thereof into paper has been decreased with considerations given to the balance with fixing performance so as to prevent the ink from spreading on the paper surface and bleeding along uneven fibers (feathering phenomenon), thus achieving improved print quality.

| Composition II (Example of the ink composition with high dot diffusion) | |
|---|---|
| Dye | 0.5 to 5 wt % |
| Glycerine | 7.5 wt % |
| Thiodiglycol | 7.5 wt % |
| Acetylene glycol | 5 wt % |
| EO additive (N = 10) | |

-continued

| Composition II (Example of the ink composition with high dot diffusion) | |
|---|---|
| Urea | 7.5 wt % |
| Pure water | Remainder |

EO: Ethylene oxide

This type of ink exhibits extremely fast fixing performance even on the general paper such as copy paper and the bond paper, and it does not cause undue color blending (boundary smearing or bleed) even when ink recording areas of different colors adjoin each other in color recording, thus presenting an advantage of uniform coloring (with minimized color irregularities).

To diffuse dots, it is effective to set the contact angle θ at a small value and to make the ink highly wettable to paper; a surfactant is usually used to improve the wettability. In the case of the ink with composition II, the surface tension thereof is small, about 30 dyne/cm, because a nonionic surfactant is added, but the wettability with respect to paper is better; therefore, the ink diffuses more easily on a paper surface (larger dots) and the penetrability is extremely good. On the other hand, however, the larger dots mean less sharpness compared with the ink having composition I above and the density of dots is lower.

Figure 7:
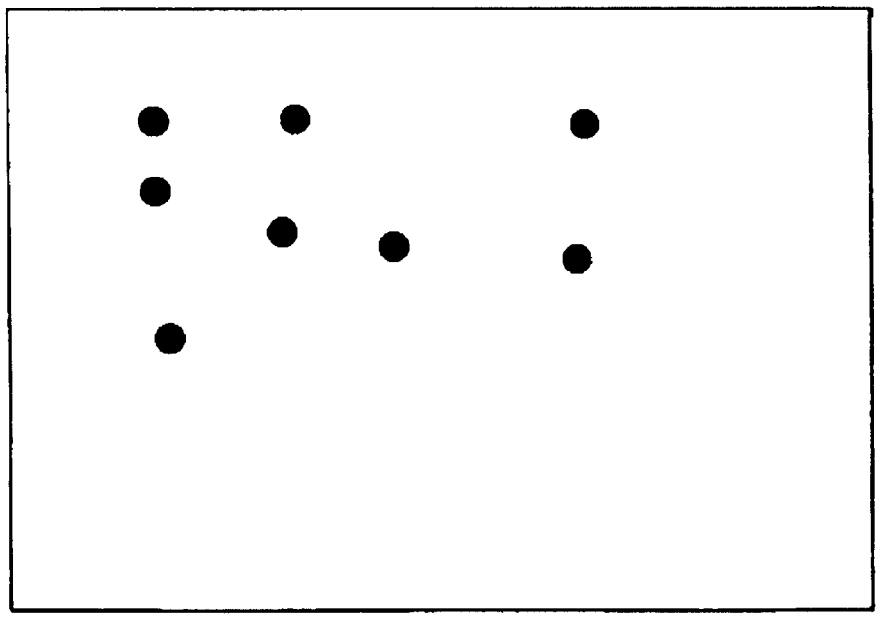
FIG. 7 is a diagram showing the state of the dots formed using an ink, the composition thereof making it difficult for dots to diffuse.
Figure 8:
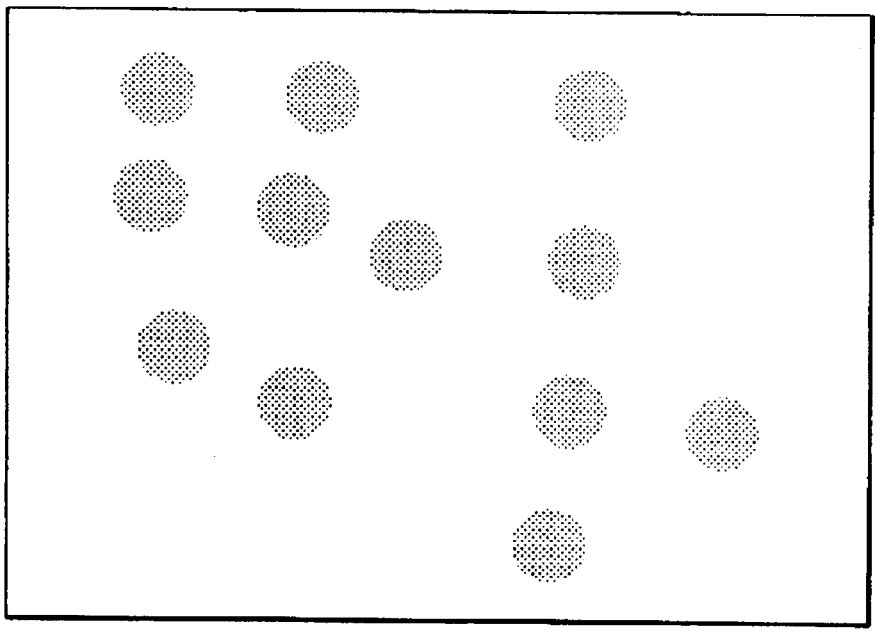
FIG. 8 is a diagram showing the state of dots formed using an ink, the composition thereof making it easy for dots to diffuse.

FIG. 7 and FIG. 8 show a conceptual difference between the dots on the paper, which are obtained when the ink of the ink composition I and the ink of ink composition II with the same dye density. FIG. 7 shows the dots produced with ink composition I; the dots do not diffuse but exhibit grainy look because the print density of dots themselves is high, leading to a high contrast with the paper. As shown in FIG. 8, however, in the case of ink composition II, the dots tend to diffuse and therefore the dye, which is the coloring material, also tends to spread as a whole, leading to a lower density of the dots themselves with a consequent lower contrast with a considerably reduced grainy look.

Figure 9:
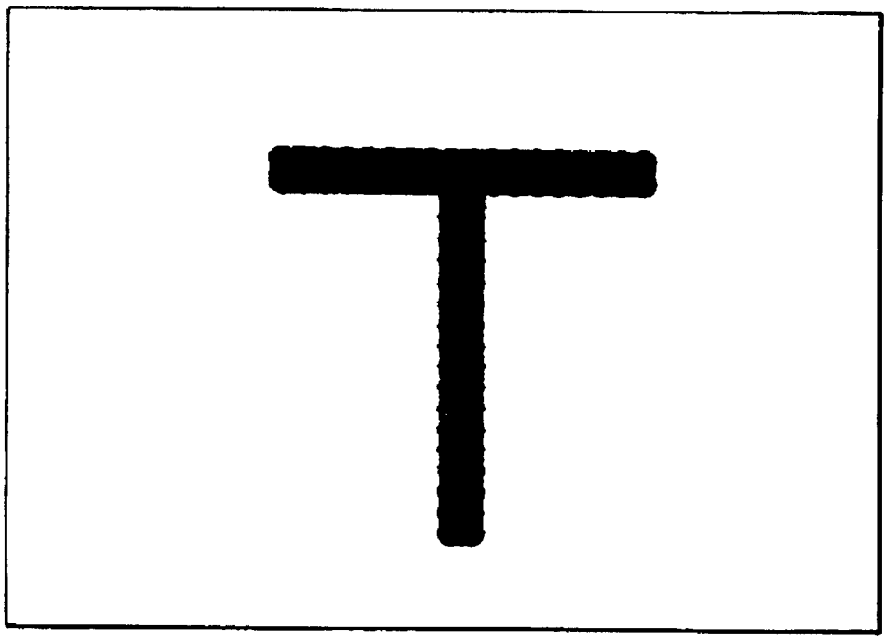
FIG. 9 shows a character quality produced using an ink, the composition thereof making it difficult for dots to diffuse.
Figure 10:
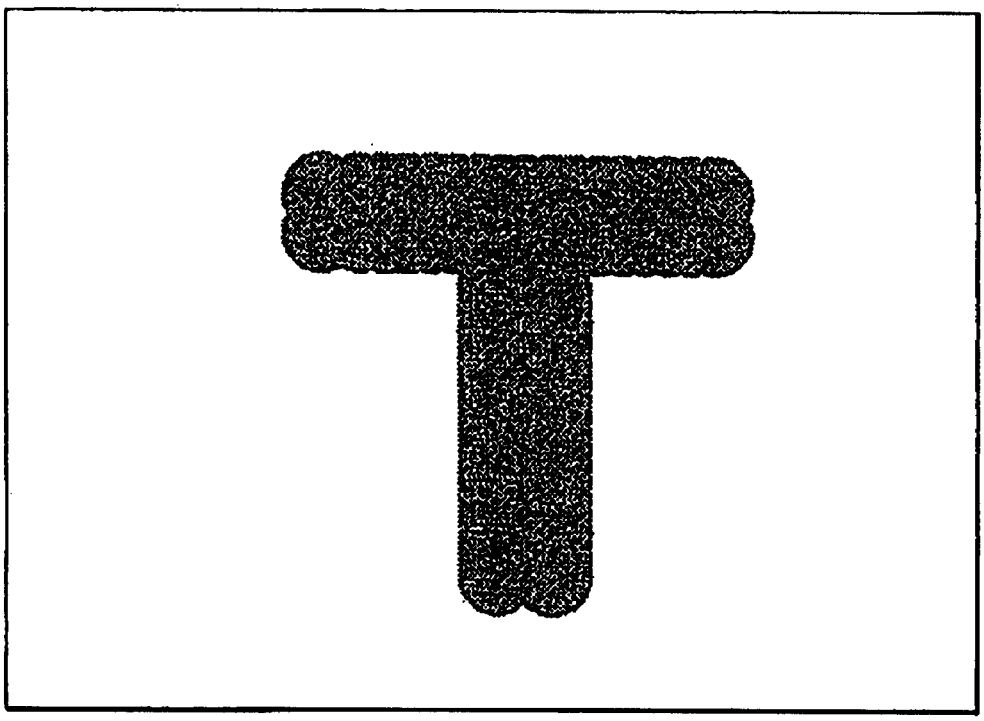
FIG. 10 shows a character quality produced using an ink, the composition thereof making it easy for dots to diffuse.

FIG. 9 and FIG. 10 give conceptual illustrations of the character qualities obtained by using ink composition I and ink composition II. FIG. 9 shows the example wherein the ink of ink composition I is used, while FIG. 10 shows the example wherein the ink of ink composition II is used. The character quality obtained when the ink of composition I is very sharp and good, while the character produced when the ink of composition II is larger and unsharp as a whole.

Figure 11:
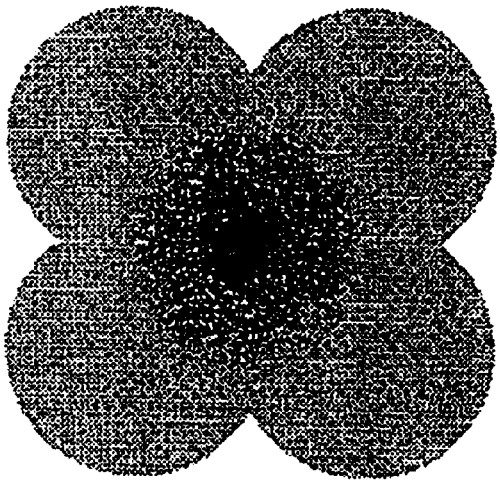
FIG. 11 is a diagram which shows the state of dots wherein the dots, which have been produced using an ink, the composition thereof making it easy for the dots to diffuse, are in contact with the dots, which have been produced using an ink, the composition thereof making it difficult for the dots to diffuse.

In this embodiment, ink composition I was used for the composition of the thick ink, while ink composition II was used for the composition of the thin ink. The use of the compositions enables the thick ink, which is frequently used for recording characters and fine lines, to perform sharp and good-quality recording; and the use of the dot-diffusing ink for the thin ink, which is used for halftone recording or especially for recording a highlighted part, allows the grainy look of the highlighted part to be less noticeable. Further, the graininess, which develops if there is a great difference in dot density between the thick ink and the thin ink in a thick-ink and thin-ink switching area, can be made less noticeable in this embodiment as shown in FIG. 11 wherein the thick-ink dots spread toward the thin-ink dot recorded area when the thin-ink dots and the thick-ink dots contact, leading to a smaller difference in density. This is interpreted that the thin ink includes the surfactant and the thin-dot recorded area permits easy wetting due to the adhering surfactant, thus allowing the thick-ink dots contacting the thin-ink dots to diffuse easily.

The way the thick-ink dots diffuse at that time may change depending on the order in which the thick ink and the thin ink are embedded. More specifically, immediately after the thick ink is embedded, the thin ink is embedded in this embodiment; the thick ink has slower penetrability and the thin ink is embedded before the thick ink is fully fixed; therefore, the inks are easily mixable on the paper surface. On the other hand, when the thin ink with faster penetrability is embedded first, and then the thick ink with slower penetrability is embedded, the inks are difficult to mix on the paper surface since the thin ink is quickly penetrates the paper, thus reducing the bleeding. This changes, depending also on the combination of the ink compositions; therefore, the embedding sequence of the thick and thin inks should be determined with considerations given to those factors.

Nonionic surfactants, which are good as the penetrants used for the thin ink, include the anionic surfactants such as the aerosol OT, dodecyl benzene sodium sulfonate, and lauryl sodium sulfate, a higher alcohol ethylene oxide addition product, which is expressed by general formula [1] shown below, an alkylphenol ethylene oxide addition product, which is expressed by general formula [2] shown below, an ethylene oxide—propylene oxide copolymer expressed by general formula [3] shown below, and an acetylene glycol ethylene oxide addition product expressed by general formula [4] given below.

The anionic surfactants listed above, however, are highly foamy and inconvenient in handling, and the nonionic surfactants are better than the anionic surfactants in image characteristics, including boundary bleeding, color uniformity, and feathering. For this reason, in this invention, the nonionic surfactants expressed by the general formulas given below were used:

General Formula [1]

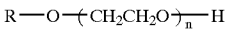

R: Alkyl group
n: Integer

General Formula [2]

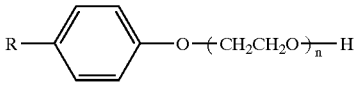

R: Alkyl group
n: Integer

General Formula [3]

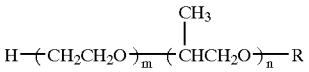

R: Alkyl group or Hydrogen
m,n: Integers

General Formula [4]

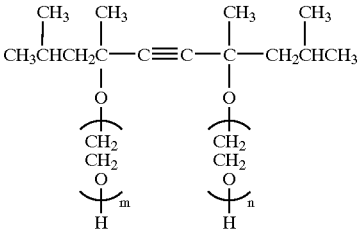

m,n: Integers

Among the ethylene oxide type nonionic surfactants listed above, the acetylene glycol ethylene oxide addition product is preferable because it is well balanced in the absorbency into an ink absorber, the image characteristics exhibited on a recording medium, the characteristic of discharge from the recording heads, and other properties. Furthermore, this compound is controlled in hydrophilic property and penetrability by a number, N, of the ethylene oxides to be added.

If N is smaller than 6, then the penetrability is better, but water-solubility is poor, leading to poor solubility to inks. In the other hand, an excessive number of added ethylene oxides causes excessive hydrophilic property, resulting in lower penetrability. If N exceeds 14, then the penetrability deteriorates; just adding more is not effective, but it will rather adversely affect the discharge property. Thus, the number of ethylene oxides to be added for this compound should range from 6 to 14.

The adding volume of these nonionic surfactants are preferably 0.1 to 20 wt %. This is because an adding volume of 0.1% or less results in unsatisfactory image characteristics and penetrability, while an adding volume of 20% or more no longer provides any further effect and it will rather adversely affect cost and ink reliability.

These nonionic surfactants may be used in a single form or in a combined form.

In addition, as the ink components, a dye as the recording agent, a low-volatility organic solvent such as a polyatomic alcohol for preventing clogging, and an organic solvent such as an alcohol for the purpose of foam stability and fixing property on a recording medium are generally added as necessary.

As a water-soluble organic solvent for forming the ink according to the present invention, there are, for example, the polyalkylene glycols such as polyethylene glycol and polypropylene glycol; the alkylene glycols, wherein an alkylene group includes 2 to 6 carbon atoms, such as ethylene glycol, propylene glycol, butylene glycol, triethylene glycol, 1,2,6-hexanetriol, hexylene glycol, and diethylene glycol; glycerins; the polyatomic alcohol lower alkyl ethers such as ethylene glycol methyl ether, diethylene glycol methyl (or ethyl) ether, and triethylene glycol monomethyl (or ethyl) ether; the alcohols such as methyl alcohol, ethyl alcohol, n-propyl alcohol, isopropyl alcohol, n-butyl alcohol, sec-butyl alcohol, tert-butyl alcohol, isobutyl alcohol, benzyl alcohol, and cyclohexanol; the amides such as dimethylformamide and dimethylacetamide; the ketones or ketone alcohols such as aceton and diacetone alcohol; the ethers such as tetrahydrofuran, dioxane; and the nitrogen cyclic compound such as N-methyl-2-pyrrolidone, 2-pyrrolidone, and 13-dimethyl-2-imidazolidinon. These water-soluble organic solvents may be contained in a volume which does not deteriorate the image characteristics and discharge reliability. Preferable ones are the polyatomic alcohols or the polyatomic alcohol alkyl ethers, the desirable content being 1 to 30 wt %.

At this time, the volume of the pure water in the ink used in the present invention is preferably 50 to 90 wt %.

Dyes used in the present invention include direct dye, acid dye, basic dye, reactive dye, disperse dye, and vat dye. The content of these dyes is generally within a range of 0.5 to 15 wt % for the total weight of the ink, preferably within a range of 1 to 7 wt % although it is determined, according mainly to the type of the liquid medium components, the characteristics required of the ink, and the discharge of the recording head.

Further, it has been found that adding thiodiglycol or urea (or an inductor thereof) to the ink dramatically improves the discharge characteristic and the effect for preventing clogging (binding). It is considered that adding them improves the solubility of the dyes into the ink. The preferable content of thiodiglycol or urea (or an inductor thereof) ranges from 1 to 30 wt %, and they may be added as necessary.

The major components of the inks according to the present invention are as described above. A viscosity modifier such as polyvinyl alcohol, cellulose, and water-soluble resin; a pH modifier such as diethanolamine, triethanolamine, and buffer solution; mildewproofing agent, and the like may be further added as necessary in an extent that does not interfere with the objects of the present invention.

To prepare the inks used for the ink-jet recording apparatus which is designed to charge the inks, a specific resistance modifier of an inorganic salt such as lithium chloride, ammonium chloride, and sodium chloride is added.

In this embodiment, the monocolor ink was used as the example for the convenience of explanation, however, the embodiment is not limited to the same; the present invention may also be applied to a color recording apparatus which is provided with a thick ink and thin ink for each of a plurality of different colors such as cyan, magenta, yellow, and black. Further, the dye density of the ink is not limited to two types, thick and thin, but it may be three or more types. For example, a low-density ink, a medium-density ink, and a high-density ink may be used for recording, so that the low-density ink and the medium-density ink may be used as the ink of composition II which allows dots to easily diffuse, while the high-density ink may be used as the ink of composition I which emphasizes the character quality.

(Second Embodiment)

Figure 12:
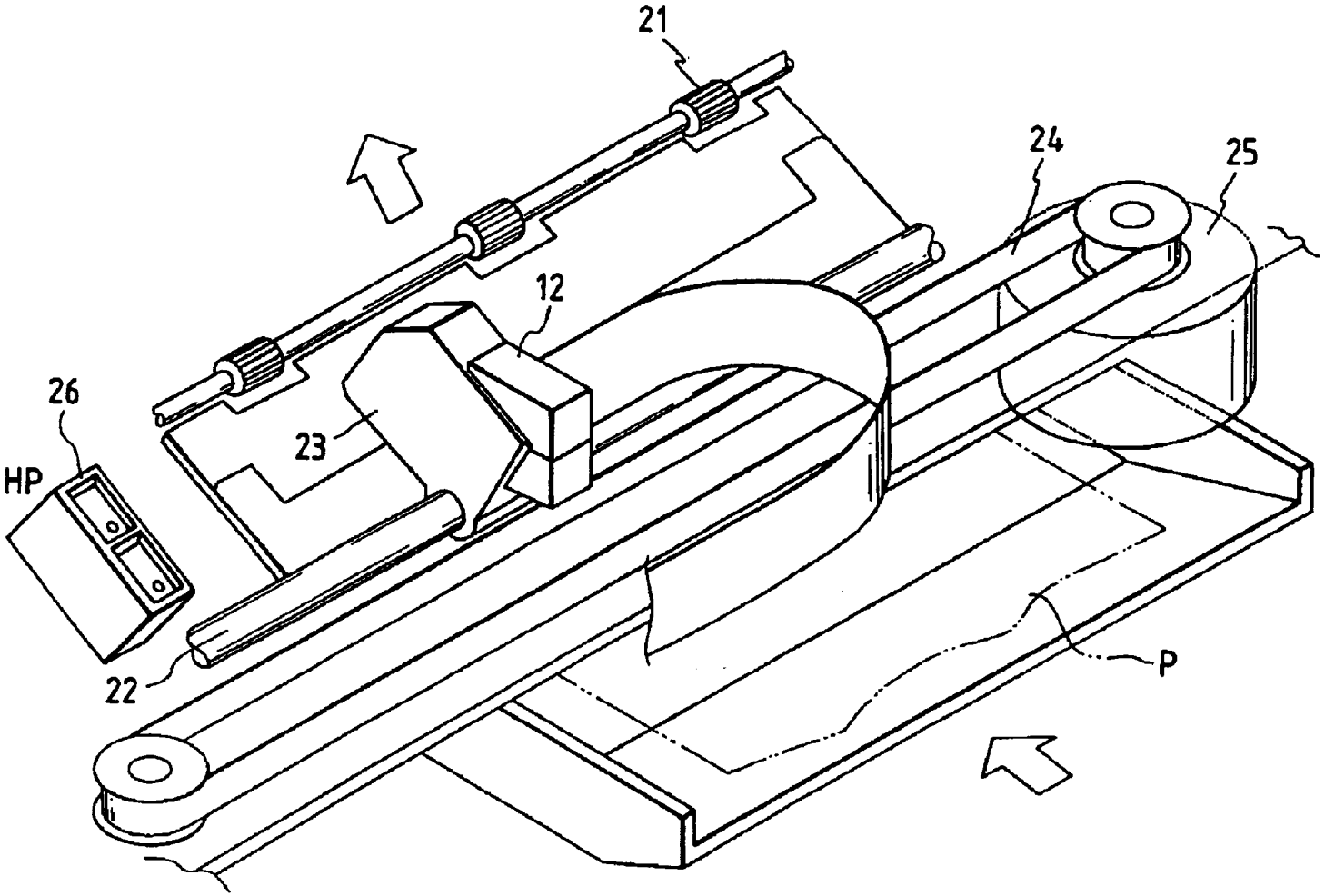
FIG. 12 is a schematic explanatory diagram of an ink-jet recording apparatus, to which the second embodiment of the present invention applies.

FIG. 12 is a perspective view which shows the configuration of the major section of the ink-jet recording apparatus in the second embodiment of the present invention, the operation thereof being basically the same as that of the first embodiment.

Figure 13:
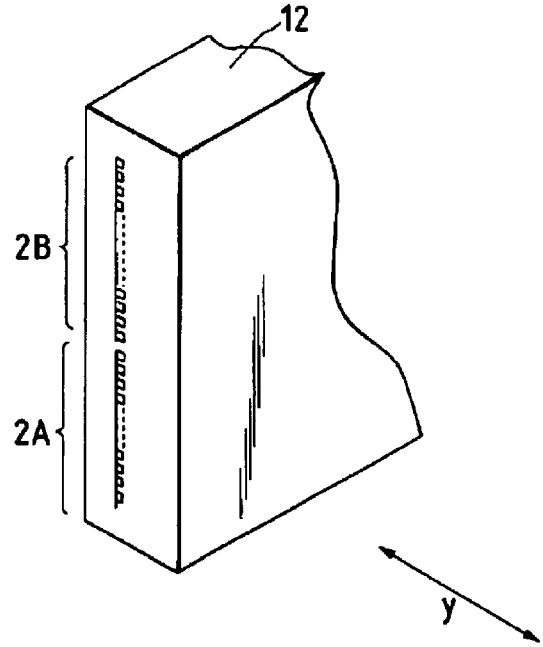
FIG. 13 is a schematic partial perspective view of the area near the discharge port of the recording head of the second embodiment.

FIG. 13 is the schematic perspective view of the ink discharge port trains of the recording head 12 observed from the side of the material to be recorded on.

This is a single recording head 12 which has a discharge port train 2A, which discharges the thick ink, and a discharge port train 2B, which discharges the thin ink.

When recording with the thick and thin inks, the problem of the disagreement in landing point between the thick-ink dots and the thin-ink dots requires careful considerations because the positional discrepancy between the thick and thin dots may change the density. The discrepancy of the vertical and horizontal registrations is eliminated by dividing and disposing a plurality of discharge port trains, which discharge the inks of different densities, in the single recording head, thus eliminating the possibility of deteriorating the image quality caused by the discrepancy in the density gradation from the dot landing position.

Figure 14:
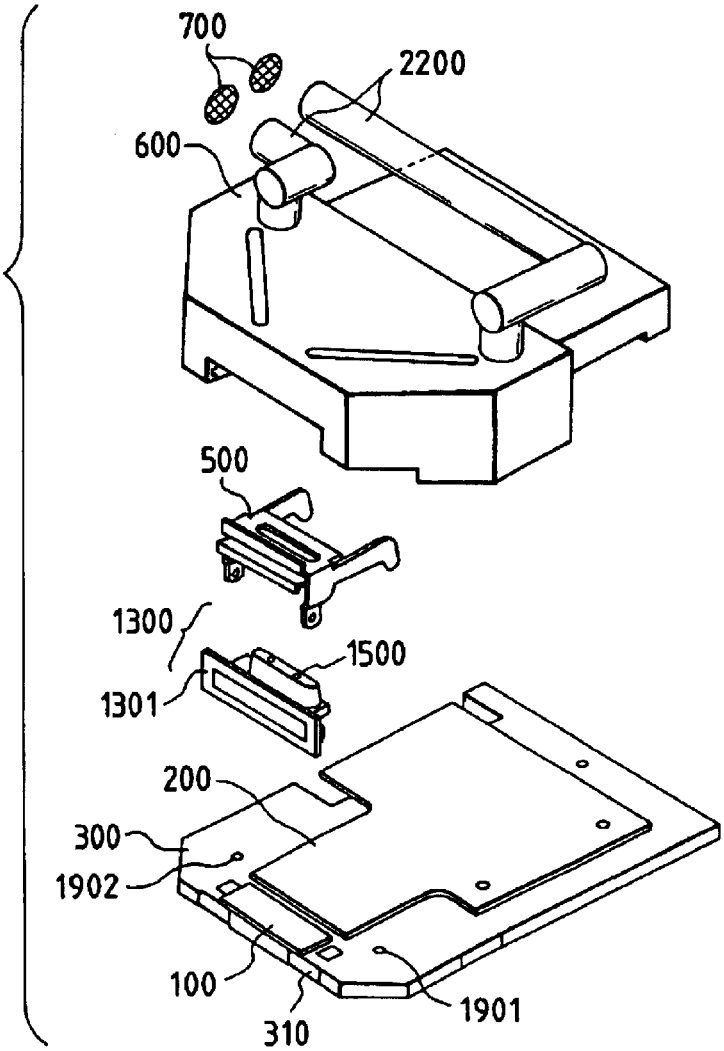
FIG. 14 is an explanatory diagram of the configuration of the recording head.

FIG. 14 is the explanatory drawing of the configuration of the ink-jet recording head used in the embodiment.

One end of a wiring board 200 is interconnected with a wiring section of a heater board 100, and the other end of the wiring board 200 is provided with a plurality of pads, which correspond to the electrothermal energy converters for receiving electrical signals from the apparatus. This allows the electrical signals from the apparatus to be supplied to the respective electrothermal energy converters.

A metallic support 300, which supports the rear surface of the wiring board 200 by the flat surface thereof, provides the bottom plate of an ink-jet unit. A holding spring 500 has a section, which is bent so that the cross-section thereof is approximately U-shaped to linearly and elastically apply a pushing force to the area near the ink discharge port of a groove top 1300, hooks, which hook themselves by utilizing the relief holes provided in a base plate, and a pair of rear legs which receive the force acting on the spring on the base plate.

The spring force presses the wiring board 200 in contact with the groove top 1300.

The wiring board 200 is mounted on the support by adhesion using an adhesive agent or the like.

The ends of ink supply pipes 2200 are provided with filters 700.

An ink supply member 600 is produced by molding, the groove top having an orifice plate section 1301 and channel 1500 leading to the ink supply ports, which are made into one piece. The ink supply member 600 can be easily fixed to the support 300 by passing two pins (not shown) on the rear surface of the ink supply member 600 into holes 1901, 1902 of the support 300 and jutting them, then thermally fusing them.

At this time, the clearance between the orifice plate section 1301 and the ink supply member 600 is evenly formed. A sealant is poured through a top sealant pouring port of the ink supply member 600 to seal the wire bonding and also seal the clearance between the orifice plate section 1301 and the ink supply member 600, further pass through a groove 310, which is provided in a support base 300, then completely seal the clearance between the orifice plate section 1301 and the front end of the support base 300.

Figure 15:
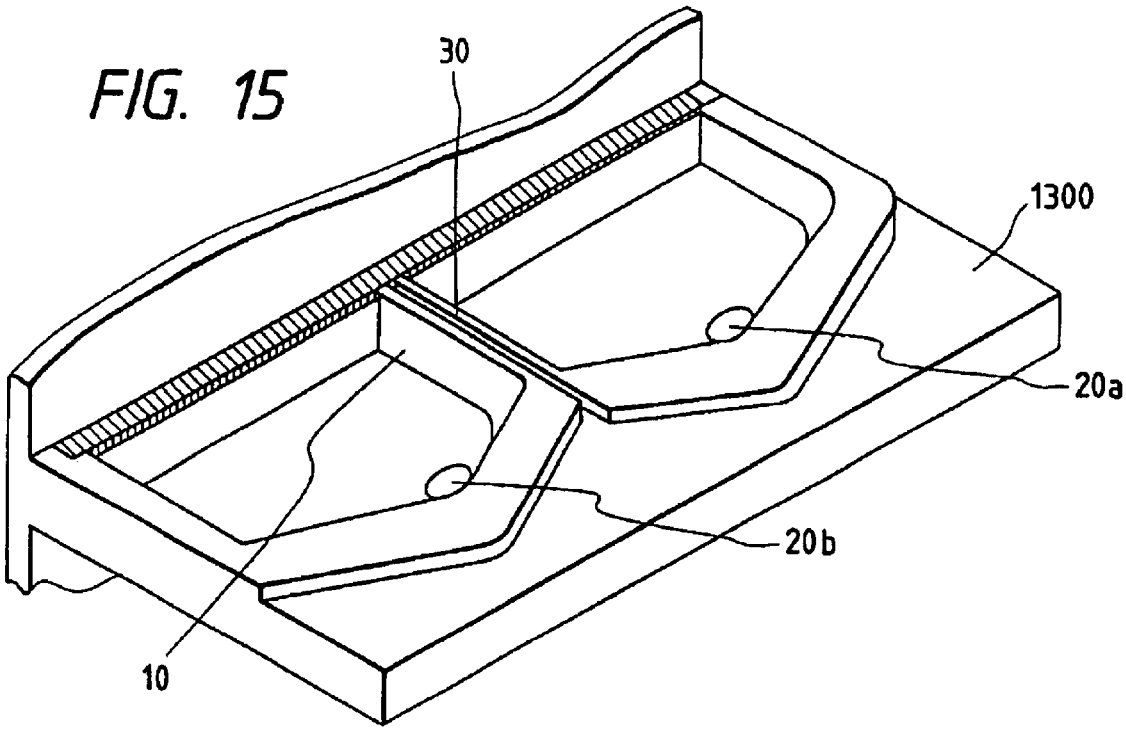
FIG. 15 is a perspective view which illustrates the structure of a groove top.

FIG. 15 is the perspective view of the groove top 1300 of the recording head used in this embodiment, the groove top being observed from the heater board 100 side. A plurality of liquid chambers are provided, each liquid chamber being partitioned by a wall 10. Each liquid chamber has supply ports 20*a* and 20*b* through which the inks are supplied.

There is provided a groove 30 at the pressure-contacted surface between the groove top and the heater board 100 of the wall 10 partitioning the liquid chambers. The groove is communicated with the outer peripheral section of the groove top 1300. After the groove top 1300 is pressure-contacted to bring it into close contact with the heater board, the outer peripheral section is sealed with the sealant as previously described. At this time, the sealant moves along the aforesaid groove to fill the clearance between the groove top and the heater board. Thus, the technical process used for the conventional head can be used to completely separate the liquid chambers. The structure of the groove differs according to the physical property of the sealant, and it needs to be designed to match each physical property.

Thus, separating a single liquid chamber into a plurality of chambers makes it possible to supply different inks through the respective ink discharge ports.

Figure 16:
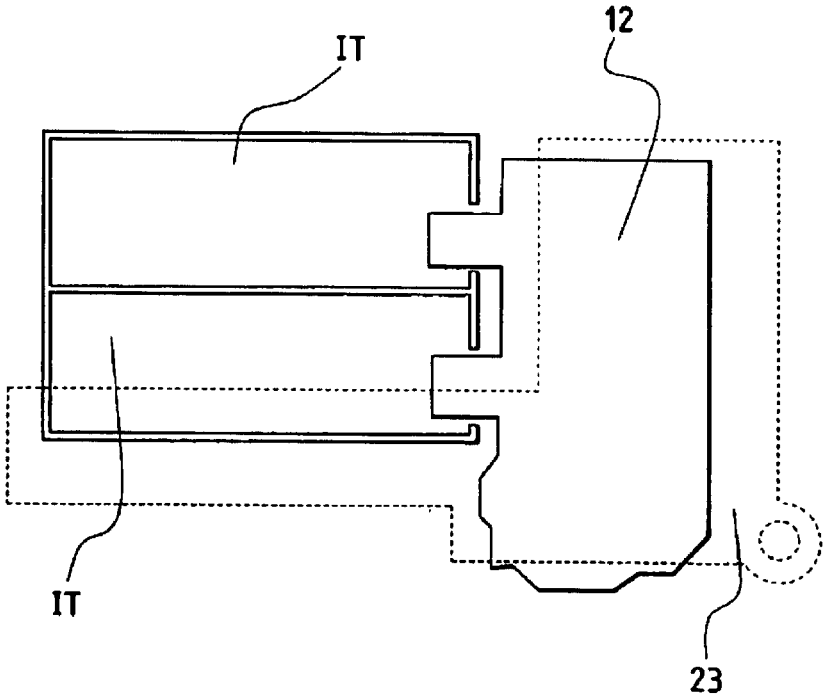
FIG. 16 is an explanatory diagram which shows the recording head and the ink tanks mounted on the carriage.

FIG. 16 shows the recording head and the ink tank of the embodiment, which have been mounted on the carriage. The ink tank IT is partitioned into two chambers, top and bottom, the top chamber being filled with the thin ink, while the bottom chamber being filled with the thick ink. On the carriage 23, the recording head 12 and the ink tank IT are connected by pressure contact, supplying the thick and thin inks from the ink tank IT to the recording head 12.

The method used, whereby input data are divided into the thin-ink data and the thick-ink data according to the dark/light distribution table, is the same as that in the case of the first embodiment; data C, M, Y, K entered in accordance with the dark/light distribution table are divided into the thin-ink data (C', M', Y', K') and the thick-ink data (C", M", Y", K"), binarized through the binarizing circuit, and output to the recording head in the form of the ON/OFF data (1-bit signals) which correspond to the individual recording elements.

An example of the ink compositions used for the second embodiment is shown below:

| Composition III (Example of the ink composition with low dot diffusion) | |
|---|---|
| Dye | 0.5 to 5 wt % |
| Diethylene glycol | 5 wt % |
| Thiodiglycol | 5 wt % |
| Ethyl alcohol | 3 wt % |
| Pure water | Remainder |

| Composition IV (Example of the ink composition with high dot diffusion) | |
|---|---|
| Dye | 0.5 to 5 wt % |
| Glycerin | 5 wt % |
| Thiodiglycol | 5 wt % |
| Ethylene oxide-propylene oxide copolymer | 3 wt % |
| Urea | 5 wt % |
| Pure water | Remainder |

In this embodiment, the ink having composition III for less dot diffusion was used as the thick-ink composition ink and the ink having composition IV for more dot diffusion as the thin-ink composition ink, the thick-ink nozzle train being disposed at the bottom and the thin-ink nozzle train at the top. In other words, in the medium-density area where both thin dots and thick dots are embedded, the thin-ink dots, which diffuse more, are embedded after the thick-ink dots, which diffuse less, are embedded. As it was mentioned in the first embodiment, the ink having the composition which allows less diffusion of dots exhibits poor penetrability with resultant slower fixing. In addition, in the vicinity of an area, where the thick and thin inks are switched and the graininess shows more easily, more dots of the thin ink are embedded than the dots of the thick ink. Hence, the thin-ink dots are embedded around the thick-ink dots, which have not yet been fully fixed, making the thick-ink dots and the thin-ink dots easier to blend, thus allowing the thick-ink dots to spread and controlling the grainy look.

According to this embodiment, the discharge port train for discharging the thick ink and the discharge port train for discharging the thin ink are combined on the single recording head, thereby eliminating the need of more recording heads and enabling a reduced size of the apparatus.

Moreover, in this embodiment, the thin ink and the thick ink are not overlapped for recording by the same single carriage scanning; instead, the thick ink is embedded by the first main scanning, then the paper is fed before the thin ink is added by the next main carriage scanning. According to the embodiment, it is possible to allow a time interval between the embedding of the thick ink and that of the thin ink; therefore, it is also possible to allow a penetrating time when the thick ink with slower penetration is embedded first, thus permitting the adjustment of the way the inks are diffused on a paper surface, in comparison with the first embodiment. Furthermore, when a bidirectional recording method is used, it is also possible to carry out control so that the diffusion stays the same for both forward and backward travels of the carriage main scanning.

In this embodiment, the monocolor ink was used as the example for the convenience of explanation, however, the embodiment is not limited to the same; the present invention may also be applied to a color recording apparatus which is provided with a thick ink and thin ink for each of a plurality of different colors such as cyan, magenta, yellow, and black.

Likewise, the dye density of the ink is not limited to two types, thick and thin, but it may be three or more types. For example, a low-density ink, a medium-density ink, and a high-density ink may be used for recording, so that the low-density ink and the medium-density ink may be used as the ink of composition which allows dots to easily diffuse, while the high-density ink may be used as the ink of composition which emphasizes the character quality.

(Third Embodiment)

Figure 17:
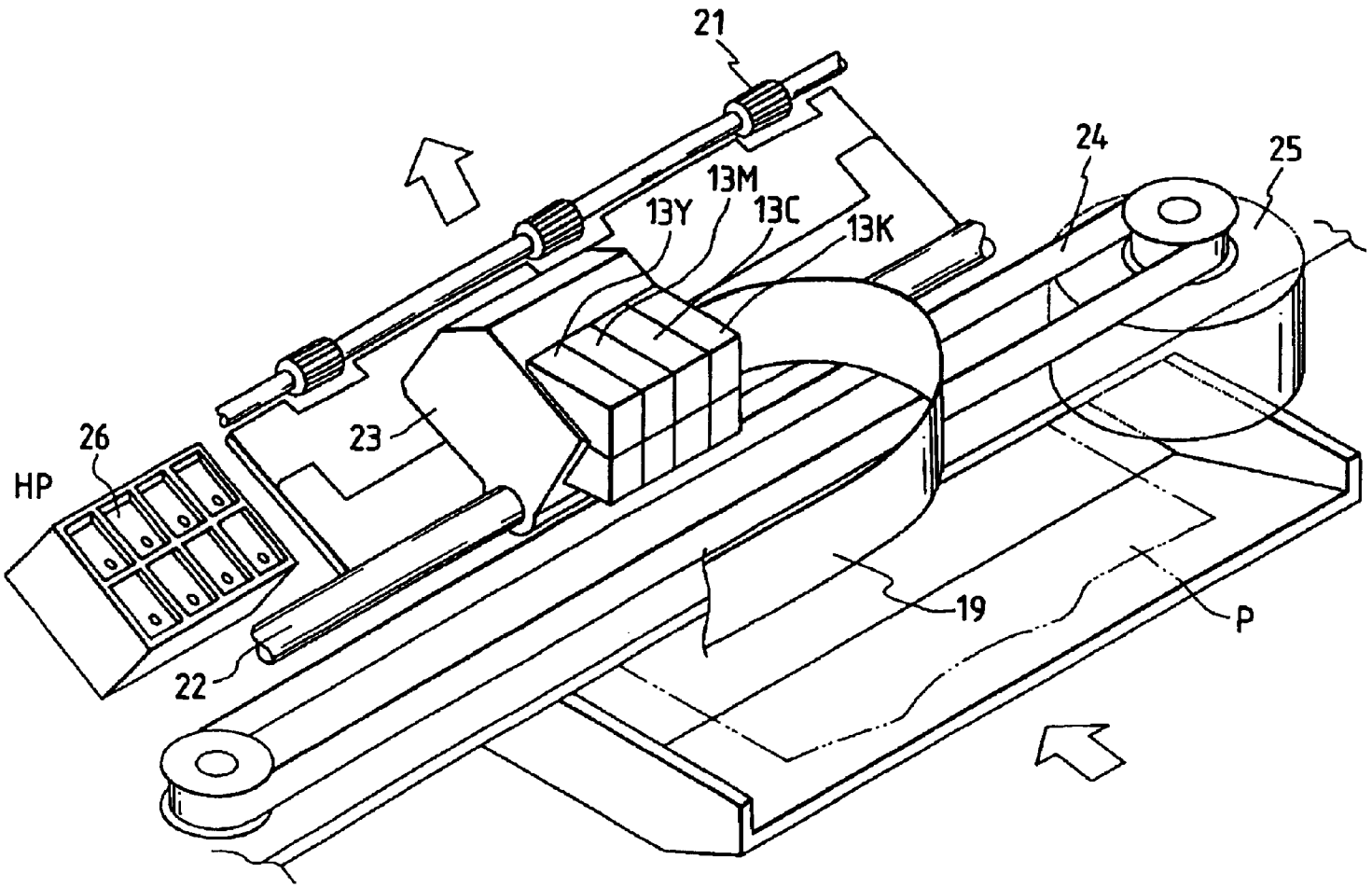
FIG. 17 is a schematic explanatory diagram of an ink-jet recording apparatus, to which the third embodiment applies.

FIG. 17 is the perspective view which shows the configuration of the major section of a color ink-jet recording apparatus in place of the recording apparatus in the second embodiment of the present invention, the operation thereof being basically the same as that of the second embodiment.

Figure 18:
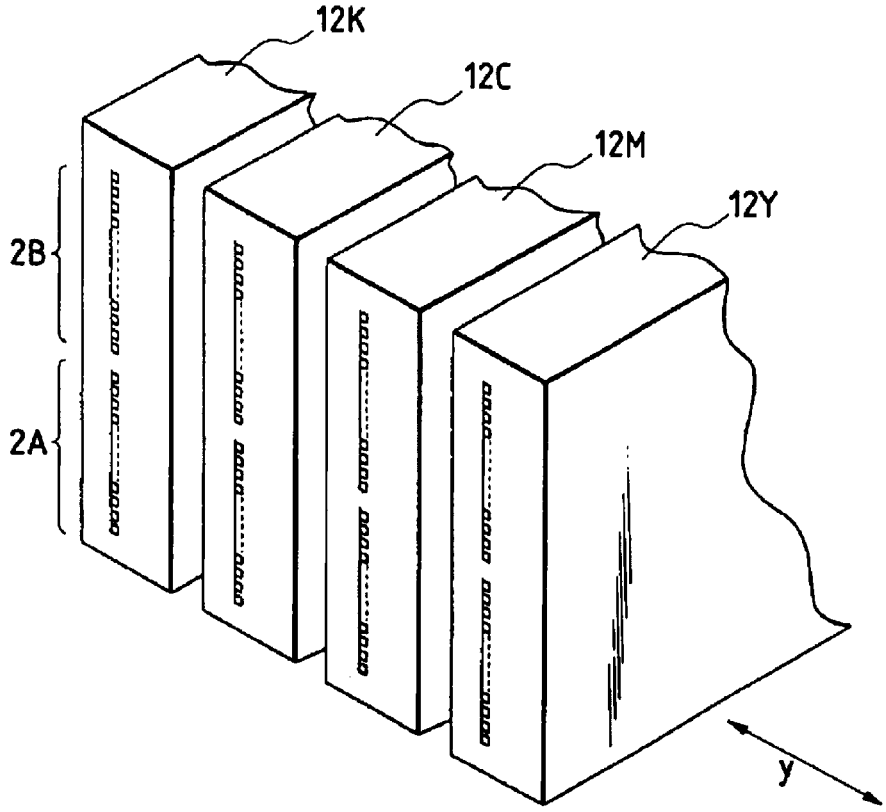
FIG. 18 is a schematic partial perspective view of the area near the discharge port of the recording head of the third embodiment.

FIG. 18 is the schematic perspective view of the ink discharge port trains of the recording head observed from the side of the material to be recorded on.

This shows a color ink-jet recording apparatus which has the recording heads of four colors; a recording head 12C, which discharges the C (cyan) ink, a recording head 12M, which discharges the M (magenta) ink, a recording head 12Y, which discharges the Y (yellow) ink, and a recording head 12K, which discharges the K (black) ink. Each of the recording heads has a discharge port train 2A for discharging the thick ink and a discharge port train 2B for discharging the thin ink, the trains being installed on the carriage with a specified distance between them.

When recording with the thick and thin inks, the problem of the discrepancy in landing point between the thick-ink dots and the thin-ink dots requires careful considerations because the positional discrepancy between the thick and thin dots may change the density. In this embodiment also, the discrepancy of the vertical and horizontal registrations is eliminated by dividing and disposing a plurality of discharge port trains, which discharge the inks of different densities, in the single recording head, thus eliminating the possibility of deteriorating the image quality caused by the discrepancy in the density gradation from the dot landing position.

Figure 19:
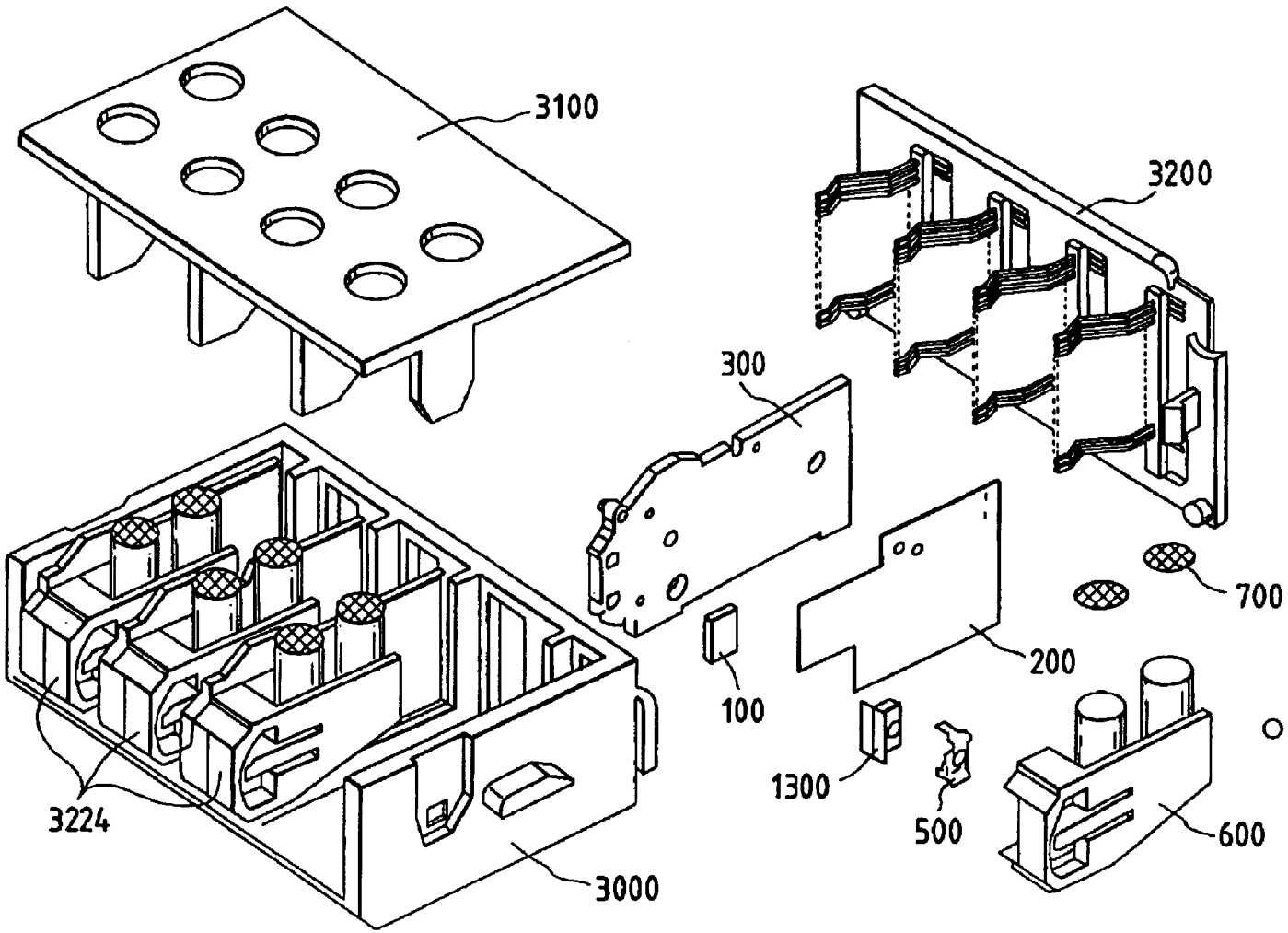
FIG. 19 is an explanatory diagram of the configuration of the ink-jet cartridge with four heads formed into one piece.

FIG. 19 shows the structure of a 4-head ink-jet cartridge (IJC), which has the recording heads of four colors, C, M, Y, and K assembled into one piece by a frame 3000. The four recording heads are mounted on the frame 3000 with specified intervals between them and fixed with the nozzle train direction thereof registered. A reference numeral 3100 is a frame cover, and 3200 is a connector for connecting the pads provided on the wiring board 200 of the four recording heads to the electrical signals received from the apparatus main body.

Figure 20:
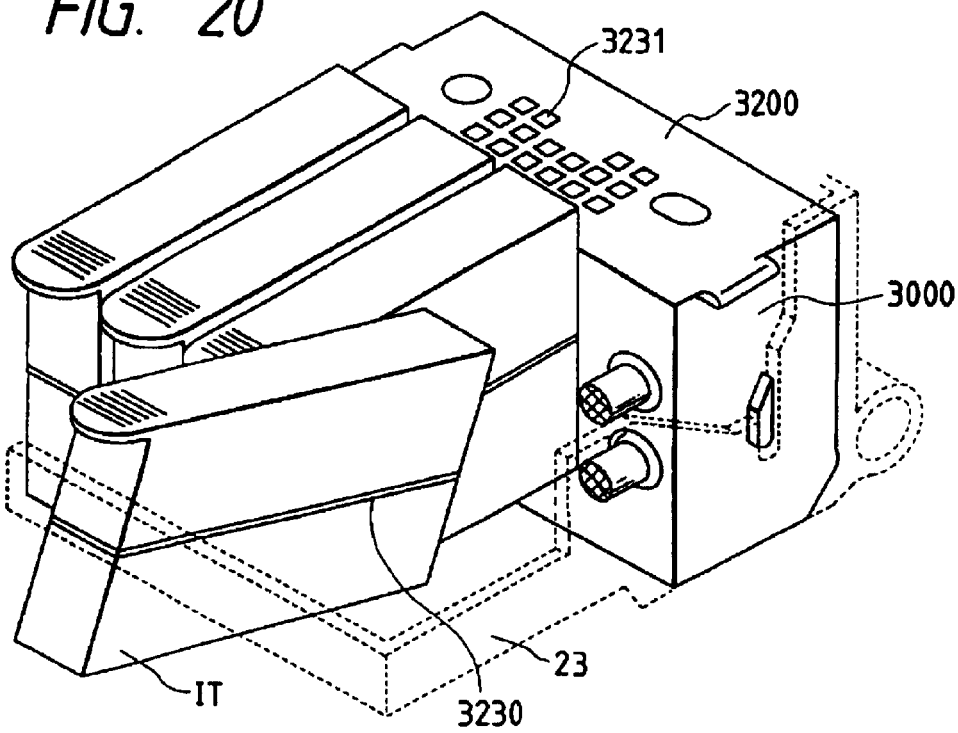
FIG. 20 is an explanatory diagram which shows the ink-jet cartridge and the ink tanks mounted on the carriage.

FIG. 20 shows the 4-head ink-jet cartridge which has been mounted on the carriage. The ink tank (IT) is partitioned into two chambers, top and bottom, the top chamber being filled with the thin ink, while the bottom chamber being filled with the thick ink. On the carriage 23, the ink-jet cartridge 3000 and the four ink tanks (IT) of C, M, Y, and K are connected by pressure contact, supplying the inks from the ink tanks to the recording heads.

The method used, whereby input data are divided into the thin-ink data and the thick-ink data according to the dark/light distribution table, is the same as that in the case of the first embodiment; data C, M, Y, K entered in accordance with the dark/light distribution table are divided into the thin-ink data (C', M', Y', K') and the thick-ink data (C", M", Y", K"), binarized through the binarizing circuit, and output to the recording heads in the form of the ON/OFF data (1-bit signals).

In the case of color recording, the diffusion in a boundary area of different colors when different colors adjoin is also important. The ink having the composition (composition I or III), which allows dots to diffuse easily as described in the first embodiment or the second embodiment, exhibits good penetration into paper and also presents an excellent characteristic in that no undue diffusion occurs in the boundary area of different colors. On the other hand, the ink having the composition (composition II or IV), which prevents easy diffusion of dots, exhibits poor penetration into paper and therefore causes diffusion and blending in the boundary area of different colors on the paper surface, leading to a deteriorated image.

In this embodiment, therefore, only the black thick ink adopted the ink composition, which prevents easy diffusion of dots, in order to enhance the quality of characters, fine lines, and the like, while the ink composition, which permits easy diffusion of dots and prevents diffusion in a different color boundary area, was adopted for the black thin ink and the thick and thin inks for cyan, magenta, and yellow in order to enhance the quality in color recording of a medium tone such as a picture of nature.

Hence, according to the first through third embodiments, the grainy look in a halftone image can be reduced, making it possible to form an image featuring good gradation and also to improve the quality of characters and the like.

(Fourth Embodiment)

The fourth embodiment of the present invention will now be described. The configuration of the ink-jet recording apparatus applied to this embodiment is the same as that shown in the block diagram of FIG. 4, and the detailed explanation thereof will be omitted.

Figure 21:
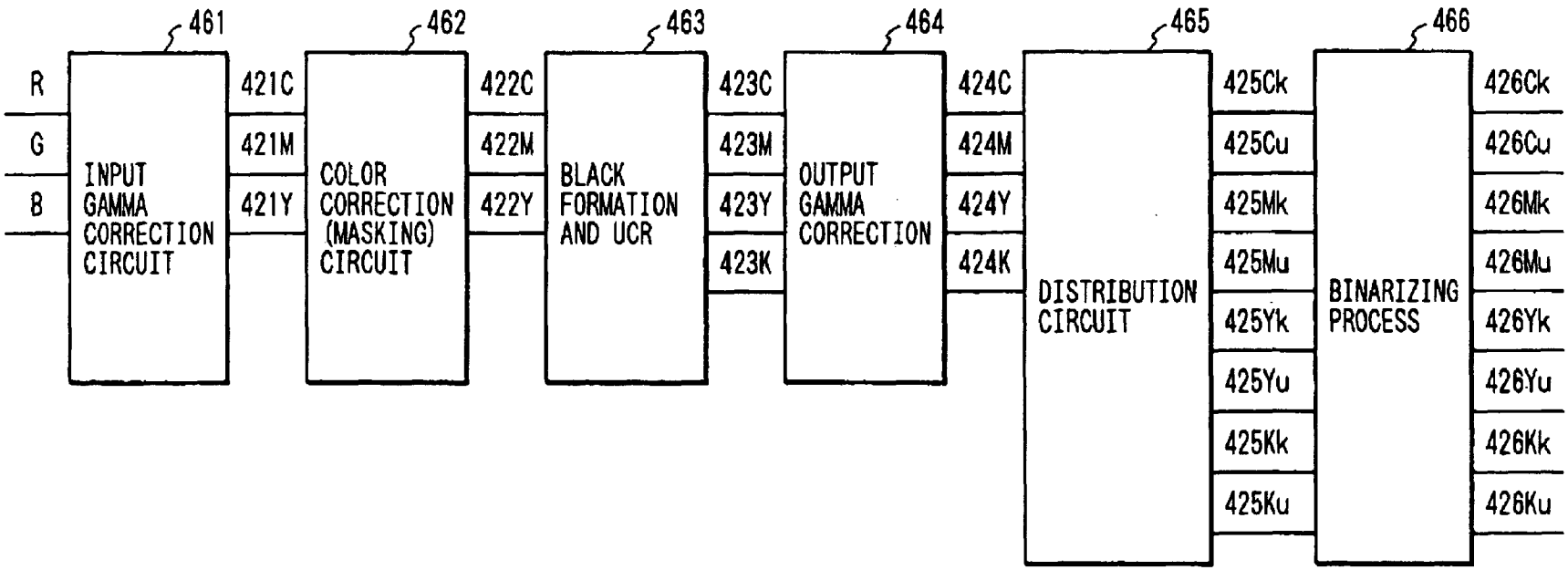
FIG. 21 is a diagram which shows an example of image processing.

The detailed explanation of an image signal processing unit 46 will be described with reference to FIG. 21.

An input gamma correction circuit 461 receives a red image luminance signal R, a green image luminance signal G, and a blue image luminance signal B, and converts the received signals into a cyan image density signal 421C, a magenta image density signal 421M, and a yellow image density signal 421Y.

The signals undergo the color processing performed by a color correction (masking) circuit 462 and a black formation and UCR (undercolor removal) circuit 463 to be further converted to new cyan, magenta, yellow, and black image density signals, 423C, 423M, 423Y, and 423K. The cyan, magenta, yellow, and black image density signals 424C, 424M, 424Y, and 424K, which have undergone the gamma correction through an output gamma correction circuit 464 further go through a dark/light distribution circuit 15 to be divided into image density signals 425C*k*, 425M*k*, 425Y*k*, and 425K*k* of the dark cyan, dark magenta, dark yellow, and dark black with high dye densities, respectively, and image density signals 425C*u*, 425M*u*, 425Y*u*, and 425K*u* of the light cyan, light magenta, light yellow, and light black with low dye density, respectively.

Figure 22A:
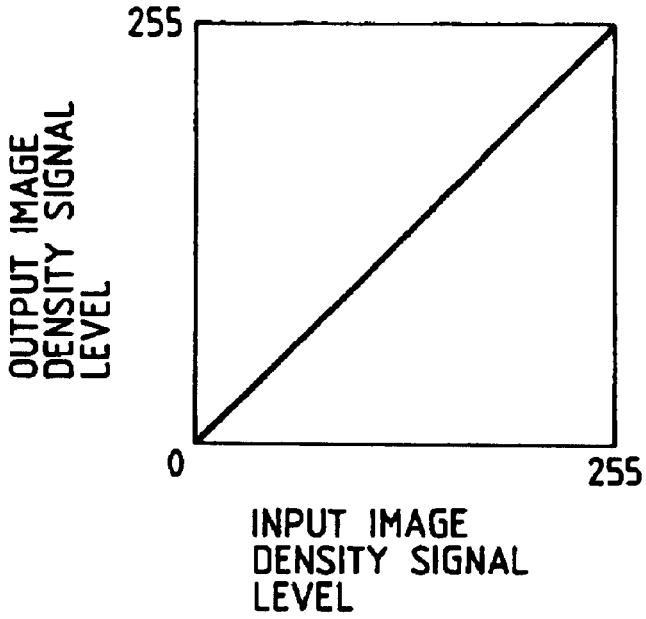
FIGS. 22A and 22B are explanatory diagrams which show examples of the dark/light distribution tables of the embodiment.
Figure 22B:
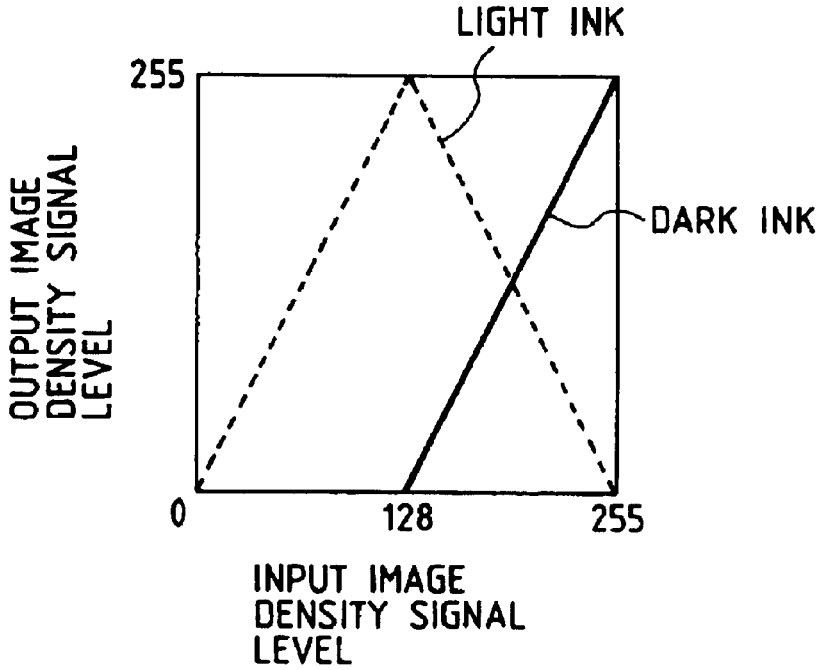

FIG. 22A and FIG. 22B show the examples of the dark/light distribution table. FIG. 22A shows the table which is used when the standard binary recording is performed by using inks of a single density. When the inks of two different densities, dark and light, are used, the conversion table of FIG. 22B which is the same one as the table shown in FIG. 6 previously.

This table is set so that the image density signal values and the optical reflection density values of a recorded image show a relationship of proportional line. The dark and light signals are produced by the dark/light distribution circuit according to the dark/light distribution table. All the image density signals, which have been divided into the dark and light signals, are binarized in the binarizing circuit to cause the inks to be discharged from the corresponding ink discharge port trains of the respective ink-jet units in accordance with the signal values, thereby forming a color image.

In the case of the table shown in FIG. 22B, the thin inks are used over all gradation areas of the image from the highlighted area to the dark area, while the dark ink is used only from the medium-tone area to the dark area.

Figure 23:
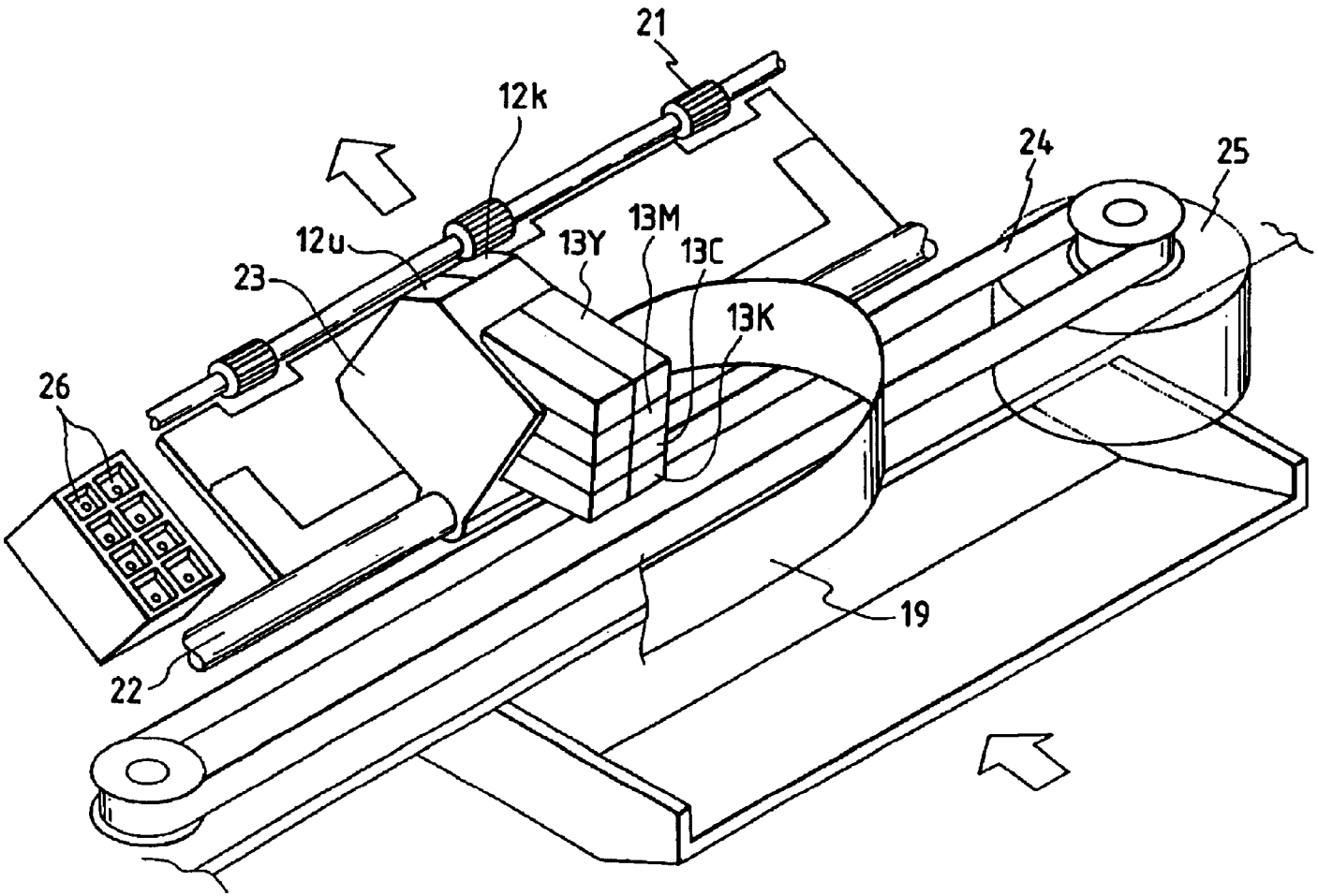
FIG. 23 is a perspective view which shows the configuration of the major section of a printing mechanism.

The printer unit of this embodiment will now be described with reference to FIG. 23. The same parts as those of the printer previously described are assigned the same reference numerals and the detailed explanation thereof will be omitted. An ink-jet head unit 12 comprises an ink-jet unit 12*u* for a thin ink and an ink-jet unit 12*k* for a thick ink, the two ink-jet units being mounted on the carriage 23 with a specified distance between them. The ink-jet unit 12*u* for a thin ink has a discharge port train for discharging a thin black ink, a discharge port train for discharging a thin cyan ink, a discharge port train for discharging a thin magenta ink, and a discharge port train for discharging a thin yellow ink. The ink-jet unit 12*k* for a thick ink has a discharge port train for discharging a thick black ink, a discharge port train for discharging a thick cyan ink, a discharge port train for discharging a thick magenta ink, and a discharge port train for discharging a thick yellow ink.

The inks for corresponding nozzle trains of ink-jet units 40 are supplied from ink cartridges 48. The ink cartridges are grouped by the same color family; 48Y is the ink cartridge which supplies the inks of dark yellow and light yellow, 48M is the ink cartridge which supplies the inks of dark magenta and light magenta, 48C is the ink cartridge which supplies the inks of dark cyan and light cyan, and 48K is the ink cartridge which supplies the inks of dark black and light black.

Inside the ink discharge ports of the ink-jet units 12, heat energy generating elements for discharging the inks are provided as in the embodiments described above.

The configuration of the ink-jet units used for this embodiment will be described with reference to FIG. 24 and FIG. 25. The same parts as those of the head unit shown in FIG. 14 and FIG. 15 explained in the embodiments above are given the same reference numerals, and the detailed explanation thereof will be omitted.

One end of the wiring board 200 is interconnected to the wiring section of the heater board 100, and the other end of the wiring board 200 is provided with a plurality of pads, which correspond to the electrothermal energy converters for receiving electrical signals from the apparatus. This allows the electrical signals from the apparatus to be supplied to the respective electrothermal energy converters.

The metallic support 300, which supports the rear surface of the wiring board 200 by the flat surface thereof, provides the bottom plate of the ink-jet unit. The holding spring 500 has the section, which is bent so that the cross-section thereof is approximately U-shaped to linearly and elastically apply a pushing force to the area near the ink discharge port of a groove top 1500, hooks 503*a*, which hook themselves by utilizing the relief holes 509*a* provided in a base plate, and a pair of rear legs 503*b* which receive the force acting on the spring on the base plate. This spring force presses the groove top 1500 to bring it in contact with the wiring board 200.

Figure 24:
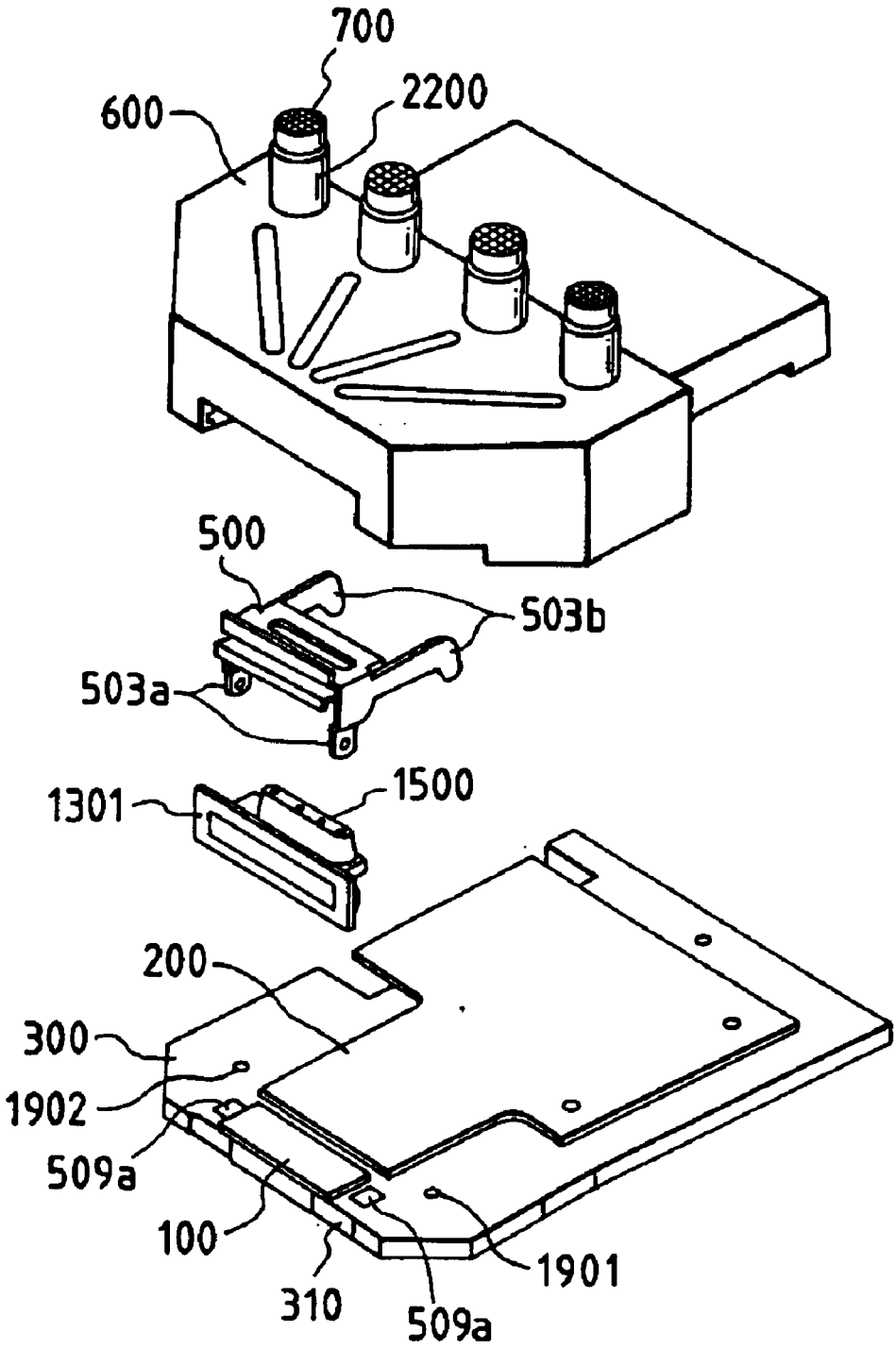
FIG. 24 and FIG. 25 are the configuration diagrams of the ink-jet unit.

As shown in FIG. 24, there are provided four ink supply pipes 2200 for yellow, magenta, cyan, and black in this embodiment. The end of each ink supply pipe 2200 is provided with a filter 700.

Figure 25:
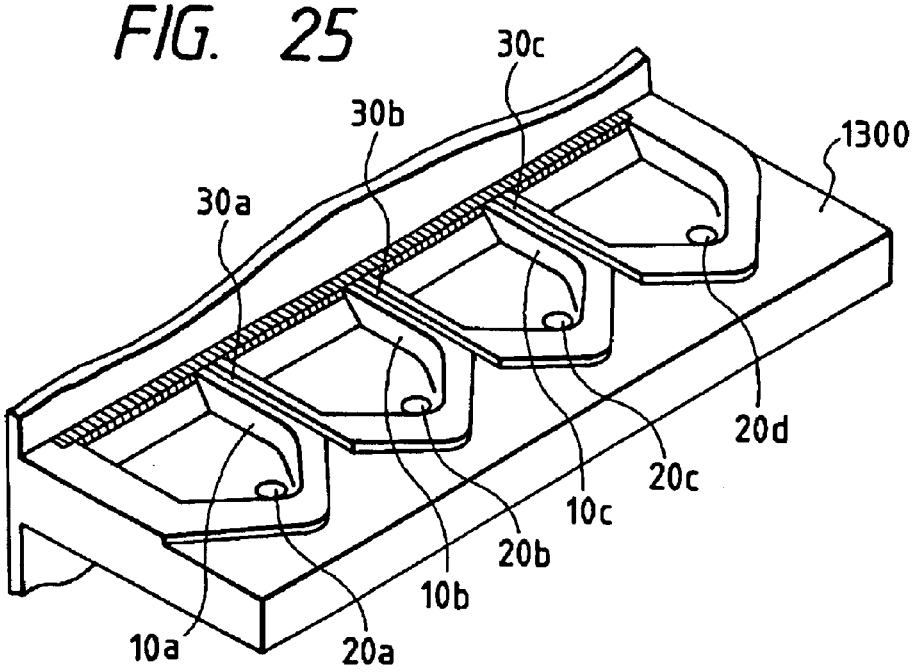

FIG. 25 is the enlarged perspective view of the groove top 1500, which is shown in FIG. 24, observed from the heater board 100 side.

In this embodiment, there are provided four liquid chambers for the yellow ink, magenta ink, cyan ink, and black ink, respectively, the liquid chambers being partitioned by walls 10*a* through 10*c*. The respective liquid chambers are provided with supply ports 20*a* through 20*d* for supplying the inks.

There are provided grooves 30*a* through 30*c* at the pressure-contacted surface between the groove top and the heater board 51 of the walls 10*a* through 10*c* partitioning the liquid chambers. The grooves are communicated with the outer peripheral section of the groove top 1500. After the groove top 1500 is pressure-contacted to bring it into close contact with the heater board, the outer peripheral section is sealed with the sealant as previously described. At this time, the sealant moves along the aforesaid grooves to fill the clearance between the groove top and the heater board. Thus, the technical process used for the conventional head can be used to completely separate the liquid chambers. The structure of the grooves differs according to the physical property of the sealant, and it needs to be designed to match each physical property. Thus, different inks can be supplied from the respective ink discharge ports by separating the liquid chamber into a plurality of chambers.

Figure 26:
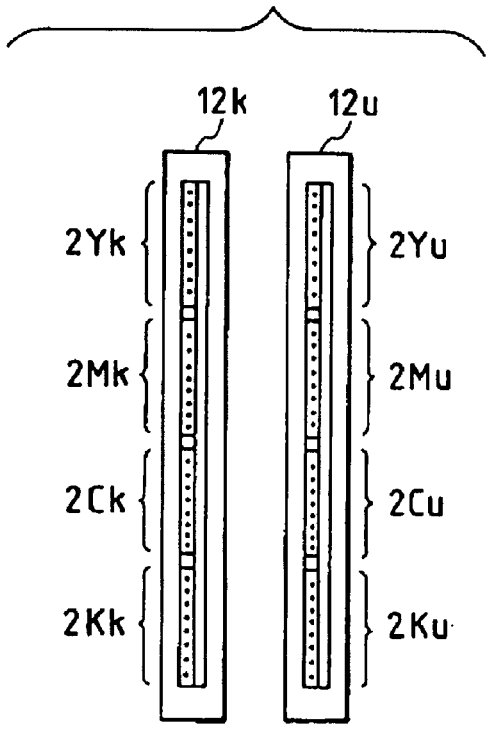
FIG. 26 is the diagram which shows the layout of the trains of the ink discharge ports of the ink-jet unit.

Referring to FIG. 26, the configuration of the ink discharge port trains and an example of forming an image will be described. FIG. 26 is a view of the ink discharge port trains of the ink-jet units observed from the side of the material to be recorded on; two ink-jet units are used for the thick inks and the thin inks, respectively, each ink-jet unit having the ink discharge port trains for yellow, magenta, cyan, and black, respectively.

In an ink-jet unit 12*k*, 2Y*k* is the discharge port train for discharging the thick yellow ink, 2M*k* is the discharge port train for discharging the thick magenta ink, 2C*k* is the discharge port train for discharging the thick cyan ink, and 2K*k* is the discharge port train for discharging the thick black ink. In an ink-jet unit 12*u*, 2Y*u* is the discharge port train for discharging the thin yellow ink, 2M*u* is the discharge port train for discharging the thin magenta ink, 2C*u* is the discharge port train for discharging the thin cyan ink, and 2K*u* is the discharge port train for discharging the thin black ink. Each discharge port train has 32 discharge ports with a pitch of 360 dots per inch (360 dpi), 8-dot blanks being provided between the respective colors by the walls of the liquid chambers.

Figure 27:
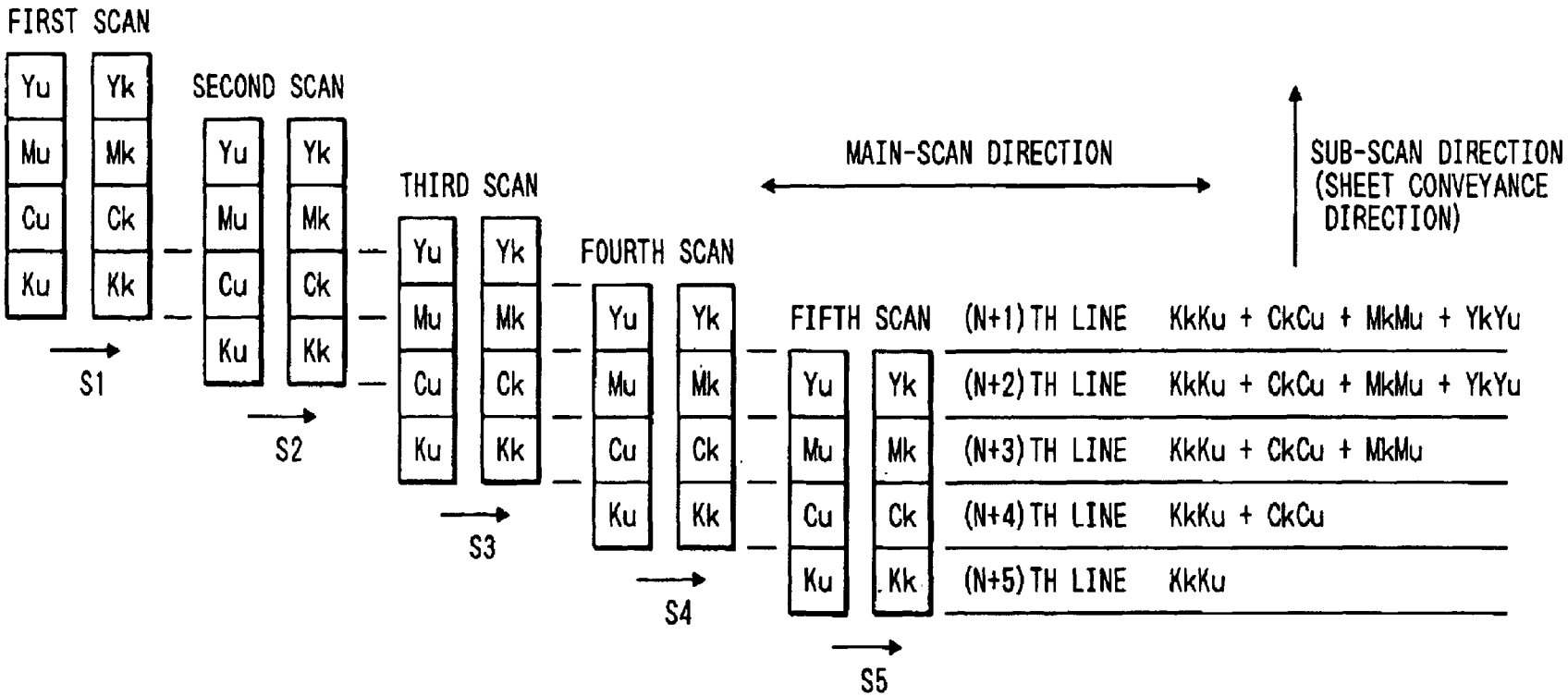
FIG. 27 is an explanatory diagram which shows an image forming process.

FIG. 27 is the diagram which shows the image forming process in this embodiment. The explanation of the diagram is based on an assumption that there is no blank between colors. Referring to the Nth+1 line, the recording with the dark black and the thin black in the first scan S1, then the material to be recorded on is carried in the sub-scan direction by a predetermined amount (line feed; hereinafter referred to as "LF"). In the second scan S2, the recording with the dark cyan and the light cyan and LF are carried out; in the third scan S3, the recording with the thick magenta and the thin magenta and LF are carried out; and in the fourth scan S4, the recording with the thick yellow and the thin yellow and LF are carried out, thus completing the image of the Nth+1 line. The LF amount after the scan recordings is equivalent to a 32-dot width, and the image of the 32-dot width is recorded by the four scan recordings. In FIG. 27, the fifth scan was performed, completing an image of the Nth+2 lines.

The recording process of the configuration example described above does not record all colors at a time, permitting the formation of a good image with minimized image deterioration caused primarily by bleeding. In an actual ink-jet unit, there are blanks between colors; therefore, the connecting positions of the recording scans of the respective colors do not coincide from one color to another as in the explanation of the diagram, the differences in position lead to such an effect that controls the occurrence of the connecting lines of the recording scans.

The use of the ink-jet units, which have divided liquid chambers and which are provided with the ink discharge ports discharging the inks of different colors, the discharge ports being formed in the same surface, makes it possible to reduce the number of the ink-jet units (recording heads) and the number of the ink cartridges, enabling a smaller apparatus. In addition, the ink-jet units used for this embodiment permit accurate and inexpensive formation of the discharge port trains for different colors in the same discharge surface; therefore, the high level of apparatus accuracy or the complicated correction control as in the conventional apparatus is no longer required, thus permitting a lower price.

The ink-jet units of this embodiment preferably have all the color discharge port trains arranged on the same straight line to reduce the correction of the ink discharge timings, however, they are not limited to this embodiment; the color discharge port trains may be arranged horizontally or arranged zigzag. Furthermore, the recording speed can be increased by changing the number of the discharge ports for each color as necessary.

Figure 28:
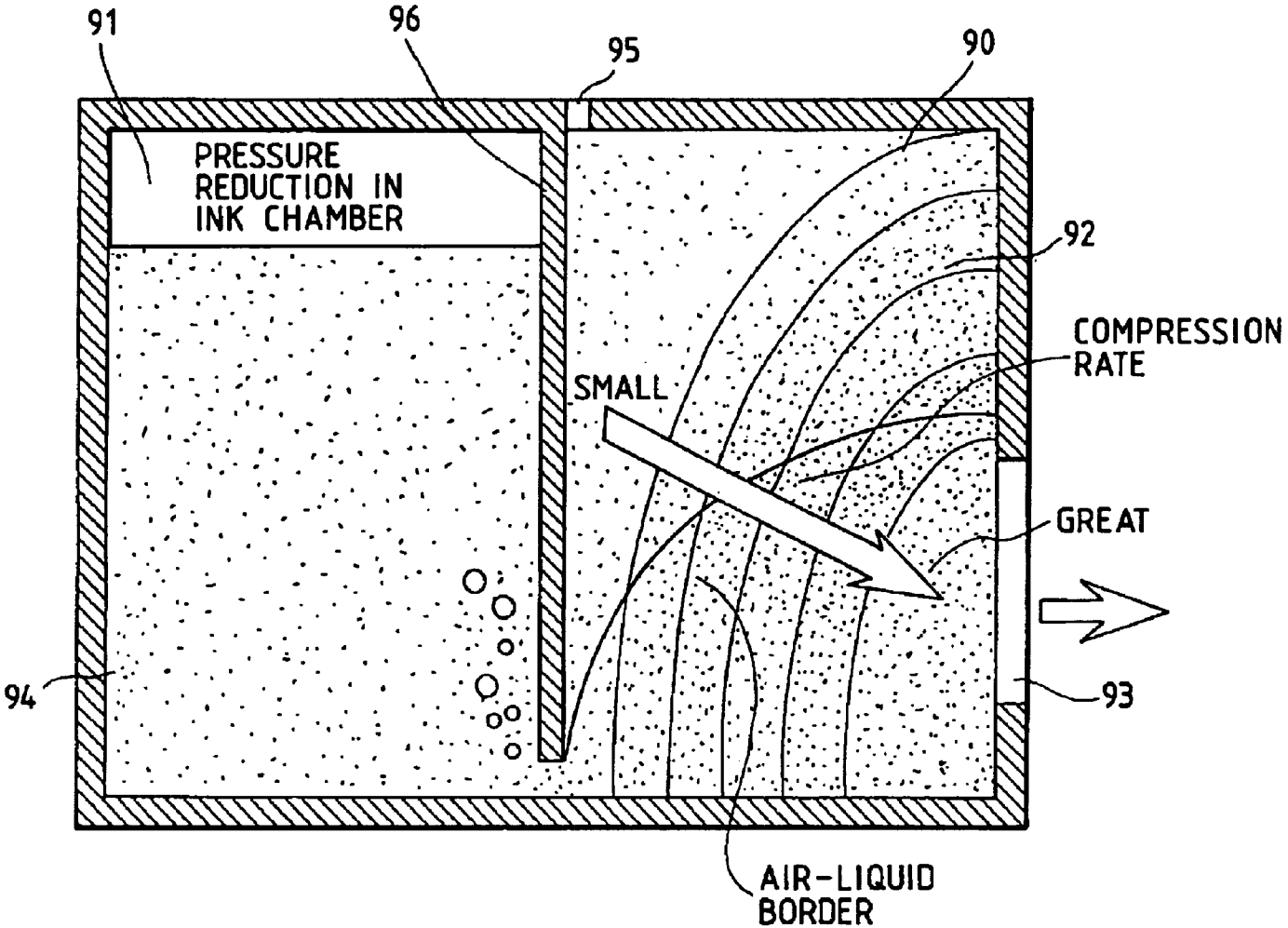
FIG. 28 is an explanatory diagram of the principle-based configuration of the ink cartridge used for the embodiment.

Referring to FIG. 28, the principle-based configuration of the ink cartridges used for this embodiment will be explained. The ink of a compressed ink absorber 92 is maintained at a height, whereat the water head pressure of the ink discharge port section of the ink-jet unit, the pressure reduction in an ink chamber 91, and the capillary tube force of the compressed ink absorber 92 are balanced. When the ink is supplied from an ink supply section 93, the volume of the ink in an ink chamber 90 does not decrease, but an ink 94 of the ink chamber 91 is consumed. More specifically, the ink distribution in the ink chamber 90 remains unchanged, and with the balanced inner pressure maintained, the volume of the ink for the supply is dispensed from the ink chamber 91 for consumption, and the air equivalent to that volume of ink is introduced from an air communicating section 95 via the ink chamber 90. At this time, the ink and the air are exchanged at the bottom end of the ink chamber wall as shown at the bottom center of FIG. 28, and the meniscus, which has been formed in the compressed ink absorber 92 of the ink chamber 90, is partially damaged in the area near the ink chamber 91, causing the air to be introduced into the ink chamber 91 so that the pressure of the ink chamber 91 is balanced mainly with the meniscus holding force of the compressed ink absorber 92.

More detailed explanation will be given about the ink supply in the ink cartridges and the principle of the generation of the negative pressure in the ink of the method used for this embodiment, the method employing the absorber to divide the ink chamber. The compressed ink absorber 92 near the ink chamber wall 96 is communicated with the air communicating section 95 under a condition where a predetermined volume of the ink in the ink chamber 90 has been consumed; therefore, it has a meniscus formed against the atmospheric pressure. In other words, the negative pressure in the ink of the ink supply section 93 is maintained by the compressed ink absorber 92 near the ink chamber wall 96, which has been compressed and adjusted to a predetermined capillary tube force. The closed space at the top of the ink chamber 91 before the ink flows out is balanced with the capillary tube force of the compressed ink absorber 92 near the ink chamber wall 96 and the water head pressure of the ink remaining in the ink chamber 91, and the pressure thereof is reduced to maintain the meniscus formed by the compressed ink absorber 92. From this condition, when the ink is supplied to the ink-jet unit via the ink supply section 93, the ink flows out of the ink chamber 91, and the pressure of the ink chamber 91 is further reduced by the volume of the ink which has been consumed. At this time, the meniscus formed in the compressed ink absorber 92 at the bottom end of the ink chamber wall 96 is partially damaged, causing the air to be introduced into the ink chamber, with the ink thereof being consumed, in order to balance with the water head pressure of the ink itself in the ink chamber 91 with the pressure thereof having been excessively reduced. In other words, the inner negative pressure of the ink supply section 93 is maintained at a specified value by the capillary tube force of the compressed ink absorber 92 close to the bottom end of the ink chamber wall 96.

Figure 29:
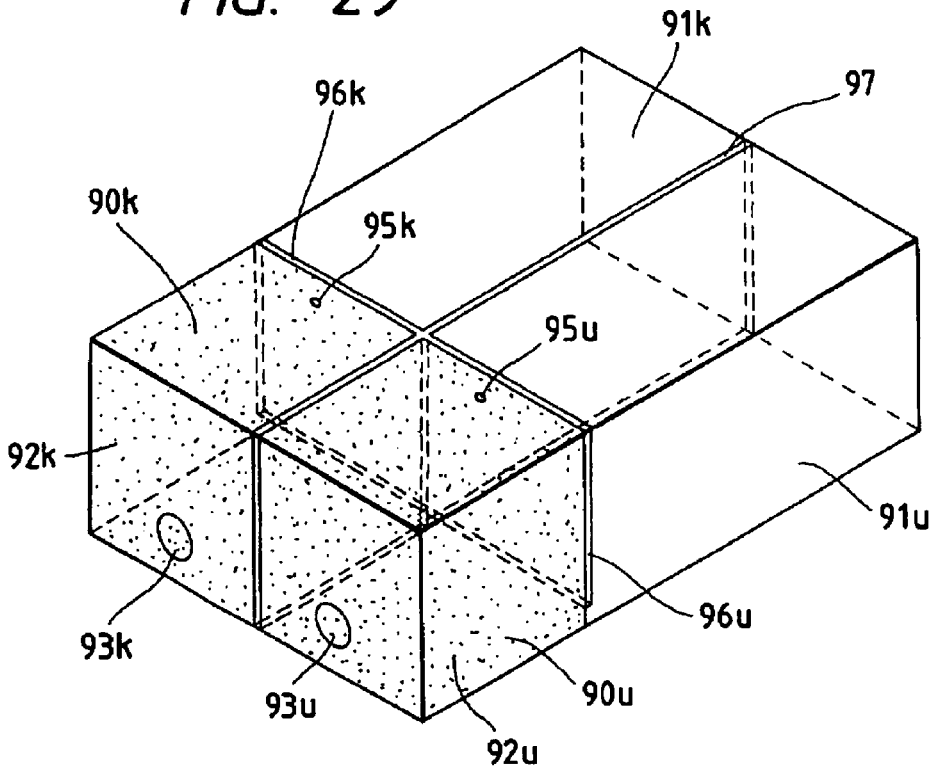
FIG. 29 and FIG. 30 are perspective views which show the configuration of the ink cartridge used for the embodiment.

FIG. 29 is the perspective view which shows the structure of the ink cartridge used for this embodiment of the present invention. The ink cartridge is divided by partitioning walls, an ink chamber 91*k* holding the dark ink, and an ink chamber 91*u* holding the light ink. The same principle as the one described above applies to the supply of the inks from the ink chambers 91*k* and 91*u* to a supply section 93*k* for the dark ink and a supply section 93*u* for the light ink.

Figure 30:
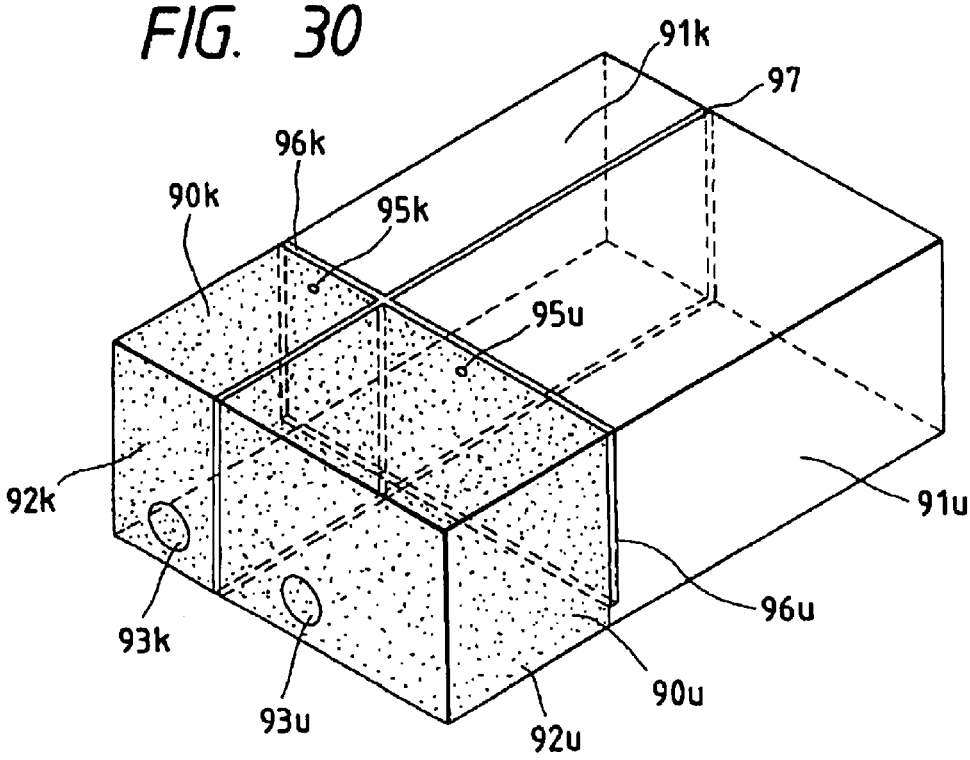

FIG. 30 is the perspective view which shows another example of the ink cartridge used for this embodiment.

FIG. 30 uses the same reference numerals as those for the ink cartridge which has been explained with reference to FIG. 29.

In the configuration of FIG. 30, the holding capacities for the dark ink and the light ink are different, the capacity for the thin ink being greater. Referring to the dark/light distribution table of FIG. 22B, the light ink is consumed for all the gradation areas of the image from the highlighted area to the dark area, while the dark ink is consumed only for the medium tone area to the dark area of the image. Hence, more light ink is likely to be consumed in recording the image. The ink cartridge of the configuration shown in FIG. 30 is capable of preventing just one ink from running out extremely quickly by making the capacity for the thin ink larger than that for the thick ink, thus making it possible to efficiently use up the ink in the ink cartridge without waste.

The ink cartridge described in this embodiment can be used primarily for a recording apparatus wherein an ink-jet unit for each ink density is prepared; it can be applied also to a case, where the inks of three different densities, namely, dark, medium, and light, or the inks of more than three different densities are used, in addition to the embodiment which uses two different densities, namely, dark and light, by increasing the number of the partitioning walls in the ink cartridge according to the number of the types of ink.

Further, the principle of holding the ink of the ink cartridge and supplying the ink is not limited to the contents of the description given above; an ink bag may be used or the whole ink chamber may be filled with a porous ink absorber to hold the ink.

Furthermore, the ink cartridge of this embodiment is mounted on the carriage just like the ink-jet unit, but the ink may be supplied to the ink-jet unit via an ink supply tube without mounting the ink cartridge on the carriage.

According to this embodiment, the number of the ink cartridges, which supply the inks to the ink discharge means, can be reduced to a minimum and the operability can be improved. Especially in a color ink-jet recording apparatus, the ink cartridges of the colors of the same group are made integral and therefore, only the ink cartridge of a color ink, which has run out, may be replaced, eliminating the waste of throwing the inks, which are used less frequently, thus providing more advantages than the case wherein the cartridges of all colors are made into one piece.

(Fifth Embodiment)

The fifth embodiment of the present invention will now be described.

The configuration of the color ink-jet recording apparatus in this embodiment is the same as the recording apparatus of FIG. 17 explained in the previous embodiment and the detailed explanation thereof will be omitted.

The ink-jet unit 12 comprises an ink-jet units 12Y, 12M, 12C, and 12K, which are not shown, for the colors, namely, yellow, magenta, cyan, and black. Each ink-jet unit has a discharge port train for discharging dark inks and a discharge port train for discharging light inks.

The inks are supplied to the ink-jet units 12Y, 12M, 12C, and 12K from the ink cartridges 13Y, 13M, 13C, and 13K. The ink cartridges contain the dark inks and the light inks together for each group of similar colors.

As in the previous embodiment, provided inside the ink discharge ports of the ink-jet units are heating elements which generate heat energy for discharging the inks.

Figure 31:
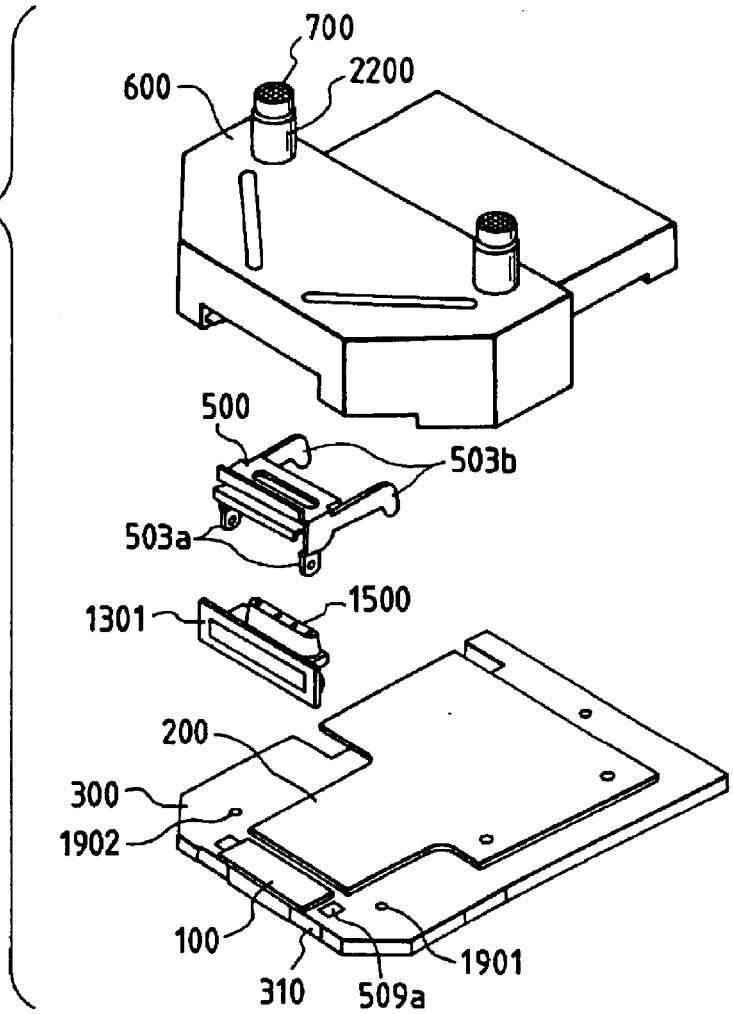
FIG. 31 is a configuration diagram of the ink-jet unit in the embodiment.

The configuration of the ink-jet unit of this embodiment is shown in FIG. 31. This configuration is identical to that of FIG. 14, and the explanation thereof will be omitted.

Figure 32:
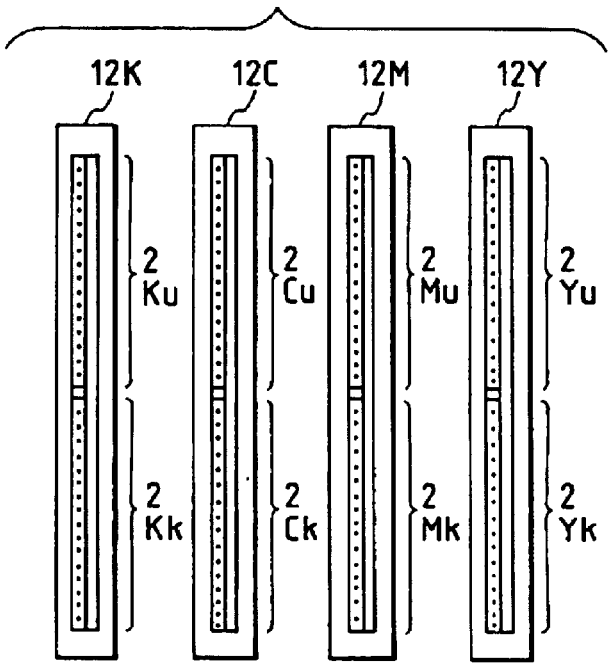
FIG. 32 is a diagram which shows the layout when an ink-jet unit, which has the discharge port trains for dark ink and light ink in the same ink-jet unit, is used.

The configuration of the ink discharge port trains and an example of forming an image will now be explained with reference to FIG. 32 and FIG. 33. FIG. 32 is a view of the ink discharge port trains of the ink-jet units observed from the side of the material to be recorded on; a single ink-jet unit has the ink discharge port trains for the thick inks and the thin inks, respectively; and the ink-jet units for yellow, magenta, cyan, and black inks are used.

The configuration of the discharge port trains is the same as the configuration of FIG. 18; each discharge port train has 64 discharge ports with a pitch of 360 dots per inch (360 dpi), 8-dot blanks being provided between the dark-ink discharge port trains and the light-ink discharge port trains by the walls of the liquid chambers.

Figure 33:
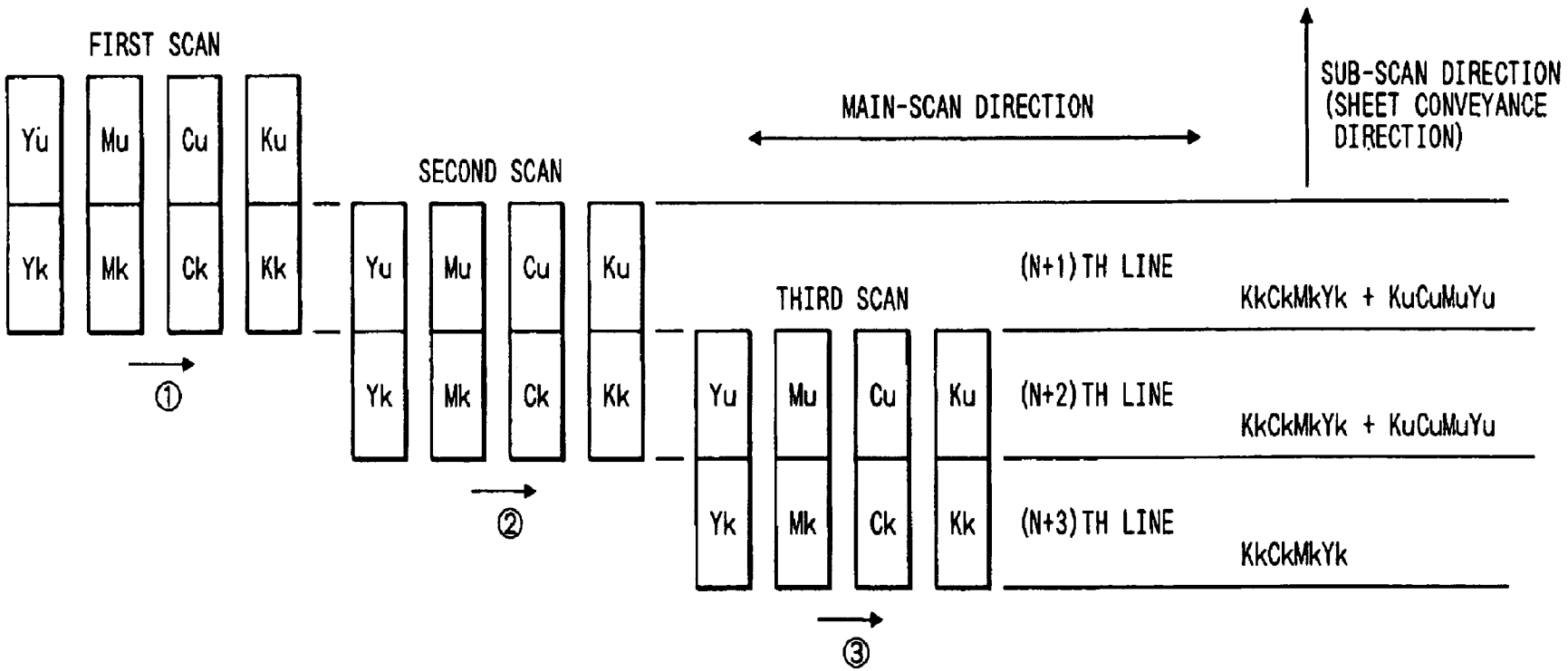
FIG. 33 is a diagram which illustrates the image forming process applied when the ink-jet unit of the ink discharge port trains shown in FIG. 32 is used.

FIG. 33 is the diagram which shows the image forming process in this embodiment. The explanation of the diagram is based on an assumption that there is no blank between colors. Referring to the Nth+1 line, the recording with the dark black, dark cyan, dark magenta, and dark yellow and LF are carried out in the first scan, then the recording with the light black, light cyan, light magenta, and light yellow and LF are carried out in the second scan, thus completing the image by the two scan recordings. The LF amount after the scan recordings is equivalent to a 64-dot width, and the image of the 64-dot width is recorded by the two scan recordings.

In this configuration, as in the previous embodiment, the recording process does not record all colors at a time; therefore, a good image with minimized image deterioration caused primarily by bleeding can be obtained. Furthermore, in an actual ink-jet unit, there are blanks between colors; therefore, the connecting positions of the recording scans of the respective colors do not coincide from one color to another as in the explanation of the diagram, the differences in position lead to such an effect that controls the occurrence of the connecting lines of the recording scans.

In addition, according to the configuration explained in this embodiment, the color blending, which is apt to take place during the discharge restoring operation, can be also effectively controlled. In particular, the ink color blending caused by ink rundown following the suction during the discharge restoring operation can be prevented by placing the discharge port trains of the inks with the low density (thin inks) at the upper side and the inks with the high density (thick inks) at the lower side.

Like the previous embodiments, this embodiment also divides the liquid chamber and uses ink-jet units provided with ink discharge ports for discharging the inks of different colors, the discharge ports being formed in the same surface, thus making it possible to reduce the number of the ink-jet units (recording heads) and the number of the ink cartridges, consequently enabling a smaller apparatus. In addition, the ink-jet units used for this embodiment permit accurate and inexpensive formation of the discharge port trains for different colors in the same discharge surface; therefore, the high level of apparatus accuracy or the complicated correction control as in the conventional apparatus is no longer required, thus permitting a lower price.

The ink-jet units of this embodiment preferably have all the color discharge port trains arranged on the same straight line to reduce the correction of the ink discharge timings, however, they are not limited to this embodiment; the color discharge port trains may be arranged horizontally or arranged zigzag.

Furthermore, as it was explained in this embodiment, the recording speed can be increased by changing the number of the discharge ports for each color as necessary.

Figure 34:
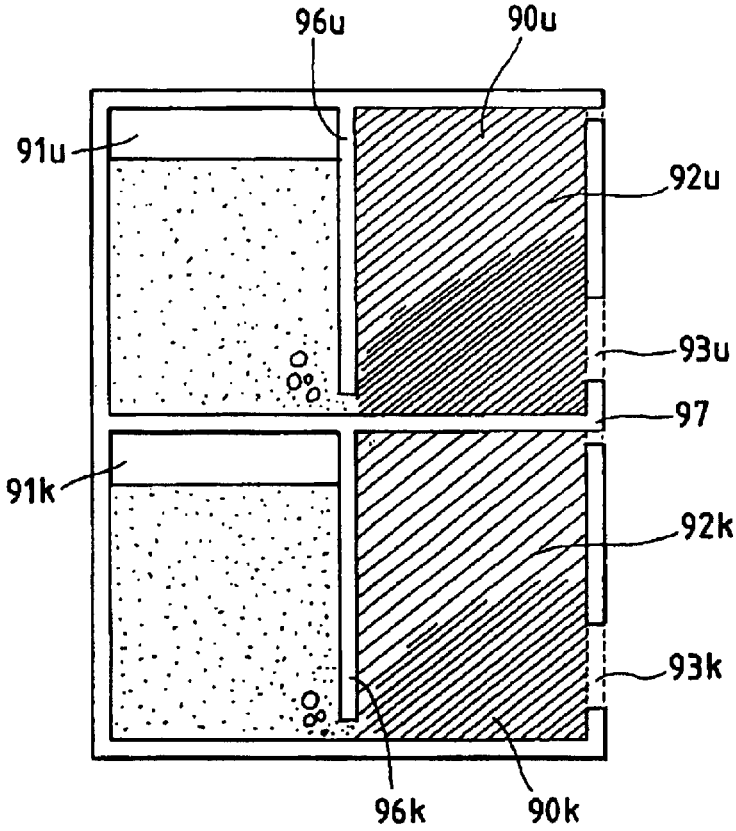
FIG. 34 and FIG. 35 are the configuration diagrams of the major section of the ink-jet cartridge used for the embodiment.

FIG. 34 is the configuration diagram which shows the major section of the ink cartridge used for this embodiment of the present invention. The same parts as those of the ink cartridge, which has been explained previously, are given the same reference numerals. The ink cartridge is divided by partitioning walls, the ink chamber 91*k* holding the dark ink, and the ink chamber 91*u* holding the light ink. The same principle as the one described above applies to the supply of the inks to the supply section 93*k* for the dark ink and the supply section 93*u* for the light ink.

Figure 35:
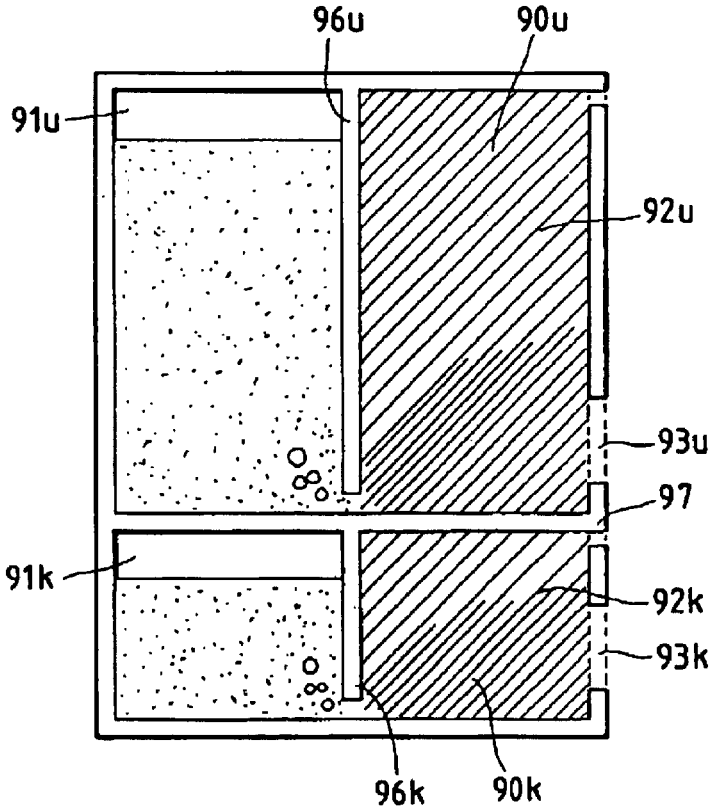
Figure 36:
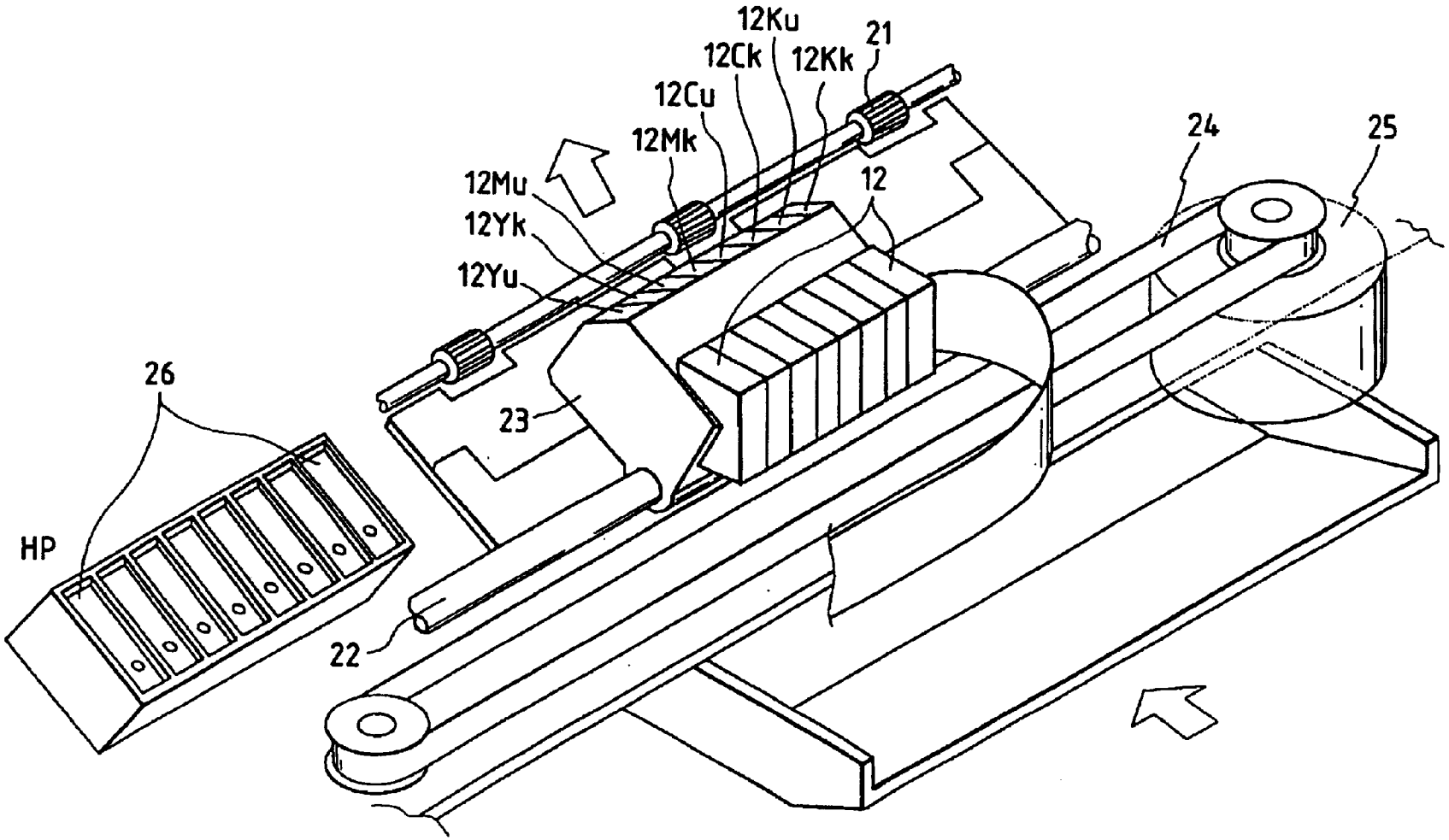
FIG. 36 is a perspective view which shows the configuration of the major section of a color ink-jet recording apparatus which employs the conventional dark and light inks.

FIG. 35 is the configuration diagram which shows the major section of another ink cartridge used for the embodiment of the present invention. The ink cartridge is divided with partitioning walls, the ink chamber 91*k* holding the dark inks and the ink chamber 91*u* holding the light inks. The inks are supplied to the dark ink supply section 93*k* and the light ink supply section 93*u* according to the principle discussed previously. In the configuration of FIG. 35, the holding capacities for the dark ink and the light ink are different. Referring to the dark/light distribution table of FIG. 22B, the light ink is consumed for all the gradation areas of the image from the highlighted area to the dark area, while the dark ink is consumed only for the medium tone area to the dark area of the image. Hence, more light ink is likely to be consumed in recording the image. The ink cartridge of the configuration shown in FIG. 35 makes it possible to efficiently use up the ink in the ink cartridge without waste by making the capacity for the thin ink larger than that for the thick ink.

The ink cartridge described in this embodiment can be applied also to a case, where the inks of three different densities, namely, dark, medium, and light, or the inks of more than three different densities are used, in addition to the embodiment which uses two different densities, namely, dark and light, by increasing the number of the partitioning walls in the ink cartridge according to the number of the types of ink.

Further, the principle of holding the ink of the ink cartridge and supplying the ink is not limited to the description given above; an ink bag may be used or the whole ink chamber may be filled with a porous ink absorber to hold the ink. Furthermore, the ink cartridges of this embodiment are mounted on the carriage together with the ink-jet units, but the inks may be supplied to the ink-jet unit via ink supply tubes without mounting the ink cartridges on the carriage.

According to this embodiment, the number of the ink cartridges, which supply the inks to the ink discharge means, can be reduced to a minimum and the operability can be improved. Especially in a color ink-jet recording apparatus, the ink cartridges of the colors of the same group are made integral and therefore, only the ink cartridge of a color ink, which has run out, may be replaced, eliminating the waste of throwing the inks, which are used less frequently, thus providing more advantages than the case wherein the cartridges of all colors are made into one piece.

(Sixth Embodiment)

The sixth embodiment of the present invention will now be described. The ink-jet unit applied to this embodiment has the same configuration as that of FIG. 19 which has been explained in the previous embodiment. FIG. 19 shows the configuration of the integral ink-jet cartridge wherein an ink-jet units 3224 of the four colors, namely, yellow, magenta, cyan, and black, are assembled into one piece by a frame 3000. The ink-jet units 3224 have the discharge port trains for discharging the dark inks and the discharge port trains for discharging the light inks. The configuration of the ink-jet units 3224 has already been explained in detail in the previous configuration example; therefore, the explanation thereof will be omitted.

FIG. 20 shows the integral ink-jet cartridge shown in FIG. 19, the cartridge having been mounted on the carriage. The ink holding and supplying principle is the same as that explained in the previous embodiment.

The ink cartridge IT is divided into two chambers, top and bottom, with a partitioner 3230, the top chamber being filled with the thin ink and the bottom chamber being filled with the thick ink. On the carriage, the ink-jet cartridge are the four ink cartridges IT for the yellow, magenta, cyan, and black inks are connected by pressure-contact, and the inks are supplied from the ink cartridges IT to the corresponding ink discharge port trains.

As in the previous embodiments, in this configuration, the recording process does not record all colors at a time; therefore, a good image with minimized image deterioration caused primarily by bleeding can be obtained. Furthermore, in an actual ink-jet unit, there are blanks between colors; therefore, the connecting positions of the recording scans of the respective colors do not coincide from one color to another as in the explanation of the diagram, the differences in position lead to such an effect that controls the occurrence of the connecting lines of the recording scans.

The integral ink-jet cartridge can be assembled to be an integral cartridge, wherein the ink-jet units, which have a plurality of ink discharge port trains in the same discharge port surface, are accurately arranged. This solves the problem of the registration discrepancy between the ink-jet units, leading to reduced correction control load. In addition, the electrical contacts of the ink-jet units can be shared, enabling a reduction in the number of the contacts to the apparatus main body.

The ink-jet units of this embodiment preferably have all the color discharge port trains arranged on the same straight line to reduce the correction of the ink discharge timings, however, they are not limited to this embodiment; the color discharge port trains may be arranged horizontally or arranged zigzag. Furthermore, the recording speed can be increased by changing the number of the discharge ports for each color as necessary.

Further, the ink cartridges are preferably mounted on the carriage just like the ink-jet cartridges, but it may be made integral with the ink-jet cartridges or the inks may be supplied to the ink-jet cartridges via an ink supply tubes without mounting the ink cartridges on the carriage.

Like the previous embodiments, this embodiment also permits a reduced size of the apparatus and also eliminates the need of the high level of apparatus accuracy of complicated correction control, enabling a lower price. Furthermore, the number of the ink cartridges supplying the inks to the ink discharge means can be reduced to a minimum, allowing improved operability.

The present invention brings outstanding effects especially in the ink-jet type recording heads and recording apparatuses which are designed to form flying droplets by utilizing heat energy to perform recording, among the ink-jet recording type recording heads or recording apparatuses.

The preferable typical configurations and principles are the ones which employ the basic principle disclosed, for example, in the specification of U.S. Pat. No. 4,723,129 and the specification of U.S. Pat. No. 4,740,796. The method can be applied to both "on-demand type" and "continuous type"; the on-demand type, in particular, is effective because by applying at least one drive signal, which corresponds to recording information and causes a quick temperature rise exceeding nuclear boiling point, to an electrothermal converter, which is disposed corresponding to a seat or liquid passage holding a liquid (ink), to generate heat energy in the electrothermal converter, thereby to cause the film boiling on the heat working surface of the recording head, consequently forming a foam in the liquid (ink), which exactly corresponds to the drive signal. The liquid (ink) is discharged through a discharge aperture by the growth, expansion and contraction of the foam, thereby forming at least one droplet. More preferably, the drive signal is formed into a pulse so that the foam will immediately and properly grow, expand and contract, achieving the discharge of the liquid (ink) featuring especially excellent responsiveness.

As the pulse-shaped drive signal, the ones disclosed in the specification of U.S. Pat. No. 4,463,359 and the specification of U.S. Pat. No. 4,345,262 are suited. Further, even better recording can be accomplished by adopting the conditions described in the specification of the invention under U.S. Pat. No. 4,313,124, which are related to the temperature rising rate of the aforesaid heat working surface.

As the configuration of the recording head, a configuration, wherein the heat working section is disposed in a bent area, may be alternatively used, the configuration being disclosed in the specification of U.S. Pat. No. 4,558,333 and the specification of U.S. Pat. No. 4,459,600 in place of the configuration combining the discharge ports, liquid passages, and electrothermal converters (linear liquid passages or right-angle liquid passages) as disclosed in the specifications mentioned above.

As still another alternative configuration, the configuration based on Japanese Patent Application Laid-Open No. 59-123670 which discloses a configuration, wherein a common slit provides the discharge section of the electrothermal converter, or the configuration based on Japanese Patent Application Laid-Open No. 59-138461, wherein the aperture absorbing the pressure wave of heat energy is made relevant to the discharge section may be used.

Further, as the full-line type recording head, which has a length corresponding to the width of the maximum recording medium on which the recording apparatus can record, either the configuration, wherein the length is satisfied by combining a plurality of recording heads as disclosed in the specifications mentioned above, or the configuration characterized by a single recording head formed as one piece may be used.

Still further, a replaceable chip type recording head, which permits electrical connection with the apparatus main body and the supply of the inks from the apparatus main body when it is mounted on the apparatus main body, or a cartridge type recording head, wherein ink tanks are provided integrally with the recording head itself, may be used.

Adding a restoring means for the recording head, standby auxiliary means, etc. to the recording apparatus of the present invention is preferable because it adds to stable effects of the present invention. To be more specific, such preferable addition, which is effective for ensuring stable recording, includes a capping means for the recording head, a cleaning means, a pressurizing or suction means, a standby heating means consisting of an electrothermal converter or a separate heating element or a combination of the former two, and the implementation of the standby discharge mode wherein discharge independent of recording is performed.

In the embodiments of the present invention described above, the description was given using the inks as the liquids; the inks solidify at or below room temperature, and most inks soften or remain liquids at room temperature; or in the ink-jet method described above, the ink temperature is controlled so that the inks stay within a range of 30° C. to 70° C. to keep the viscosity of the inks within the stable discharge range; therefore, any inks are acceptable as long as they are liquids when the recording signal is applied.

In addition, the rising temperature caused by the heat energy may be actively used as the energy for changing the state of the ink, that is, from the solid state to the liquid state; or an ink, which solidifies when it is let stand, may be used for the purpose of preventing the ink from evaporating; or an ink, which liquefies when heat energy is applied in response to the recording signal and which is discharged as a liquid ink; or an ink, which begins to solidify already at the point of reaching the recording medium; all those inks which liquefy only when heat energy is applied to the same, may be applied to the present invention. In such a case, the ink may be held as a liquid or solid material in a porous seat concave or a through hole, facing the electrothermal converter, as described in Japanese Patent Application Laid-Open No. 54-56847 or Japanese Patent Application Laid-Open No. 60-71260. In the present invention, implementing the film boiling method mentioned above is most effective for the inks described above.

Still further, the recording apparatus according to the present invention may take a form of a copying apparatus combined with a reader or the like, or a facsimile apparatus having a transmitting and receiving feature, in addition to the form wherein the recording apparatus is provided in the form of an image output terminal as a part of or independently of information processing equipment such as a word processor and computer as mentioned above.

Figure 37:
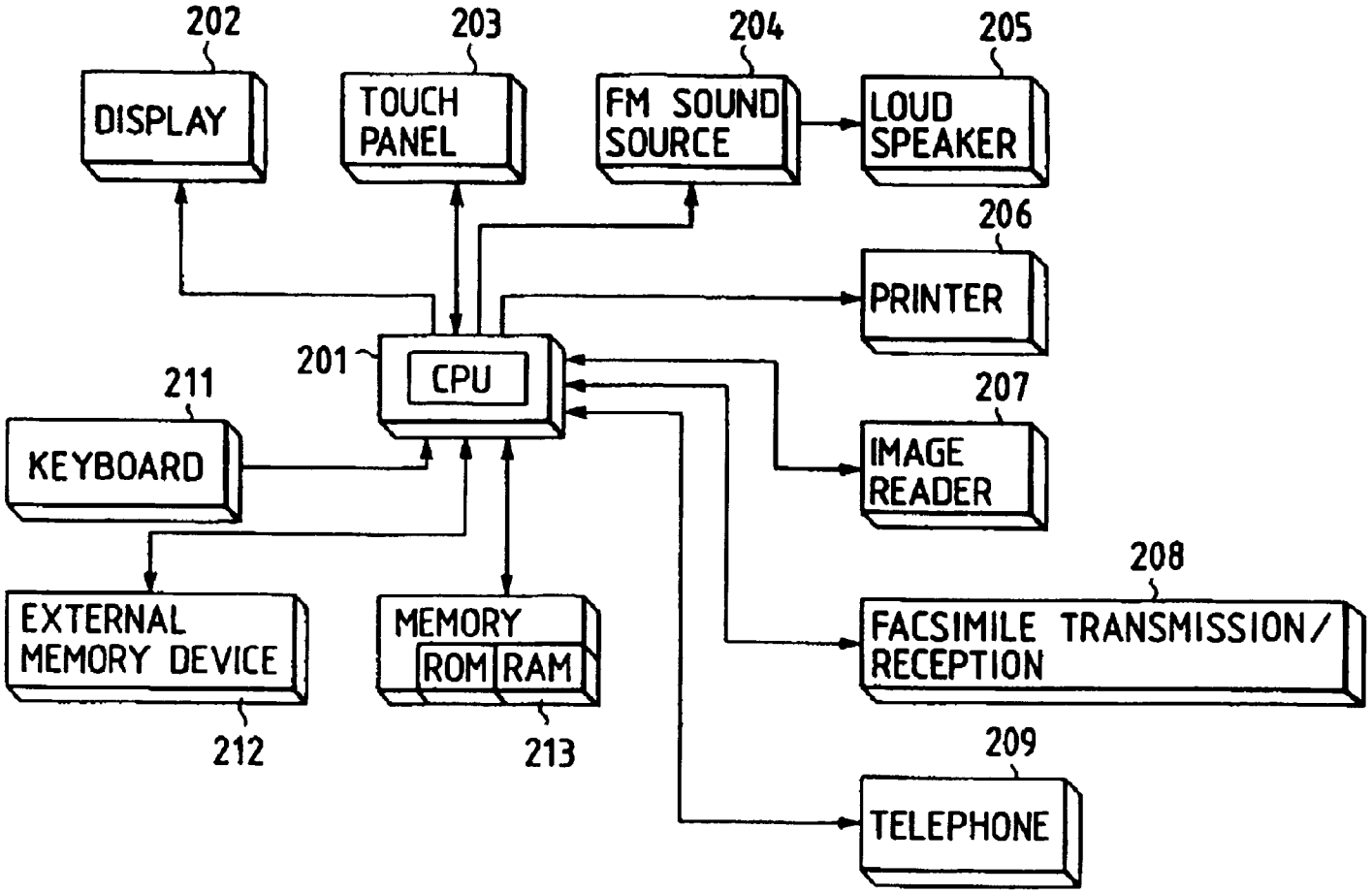
FIG. 37 is a block diagram which shows the schematic configuration wherein the recording apparatus according to the present invention applies to an information processing apparatus.

FIG. 37 is the block diagram which shows the schematic configuration used when the recording apparatus of the present invention is applied to an information processing apparatus which has a function as a word processor, personal computer, facsimile apparatus, copying apparatus, electronic typewriter, etc. In the diagram, 201 is a controller which controls the whole apparatus; it is provided with a CPU such as a microprocessor and diverse I/O ports, and it performs control by issuing control signals, data signals and the like to all component units and by receiving control signals and data signals from all the component units. A reference numeral 202 denotes a display unit, the display screen thereof showing various menus, document information, and image data or the like read through an image reader 207. A reference numeral 203 denotes a transparent pressure-sensitive touch panel provided on the display unit 202; articles, coordinate positions, etc. can be entered on the display unit 202 by pressing the surface of the touch panel by fingers or the like.

A reference numeral 204 denotes an FM (frequency modulation) sound source unit which stores music information created by a music editor or the like in a memory 210 and an external memory 212 as digital data then reads out the stored data from the memory or the like to submit it to FM. The electrical signals from the FM sound source unit 204 are converted to audible sounds through a speaker 205. A printer 206 uses the recording apparatus according to the present invention as the output terminal of the word processor, personal computer, facsimile apparatus, copying apparatus, electronic typewriter, etc.

A reference numeral 207 is an image reader which reads and inputs an original photoelectrically; it is provided in the middle of the original delivery passage and it reads various types of originals, including a facsimile original and copy original. A reference numeral 208 denotes a facsimile transmitting and receiving unit which transmits the original data read through the image reader 207 and receives and decodes transmitted facsimile signals, and it has a feature for interfacing with external equipment. A reference numeral 209 denotes a telephone unit which has various telephone functions, including regular telephone functions and an answering machine function. A reference numeral 210 denotes is a memory which mainly contains a system program, manager program, and other application programs, a ROM for storing character fonts, dictionaries, etc., the application programs and character information loaded from the external memory 212, and a RAM.

A reference numeral 211 is a keyboard through which document information, various commands, etc. are entered. A reference numeral 212 is the external memory which uses floppy disks, hard disks, and the like as its storage media; character information, music, sound information, user's application programs, etc. are stored in this external memory 212.

Figure 38:
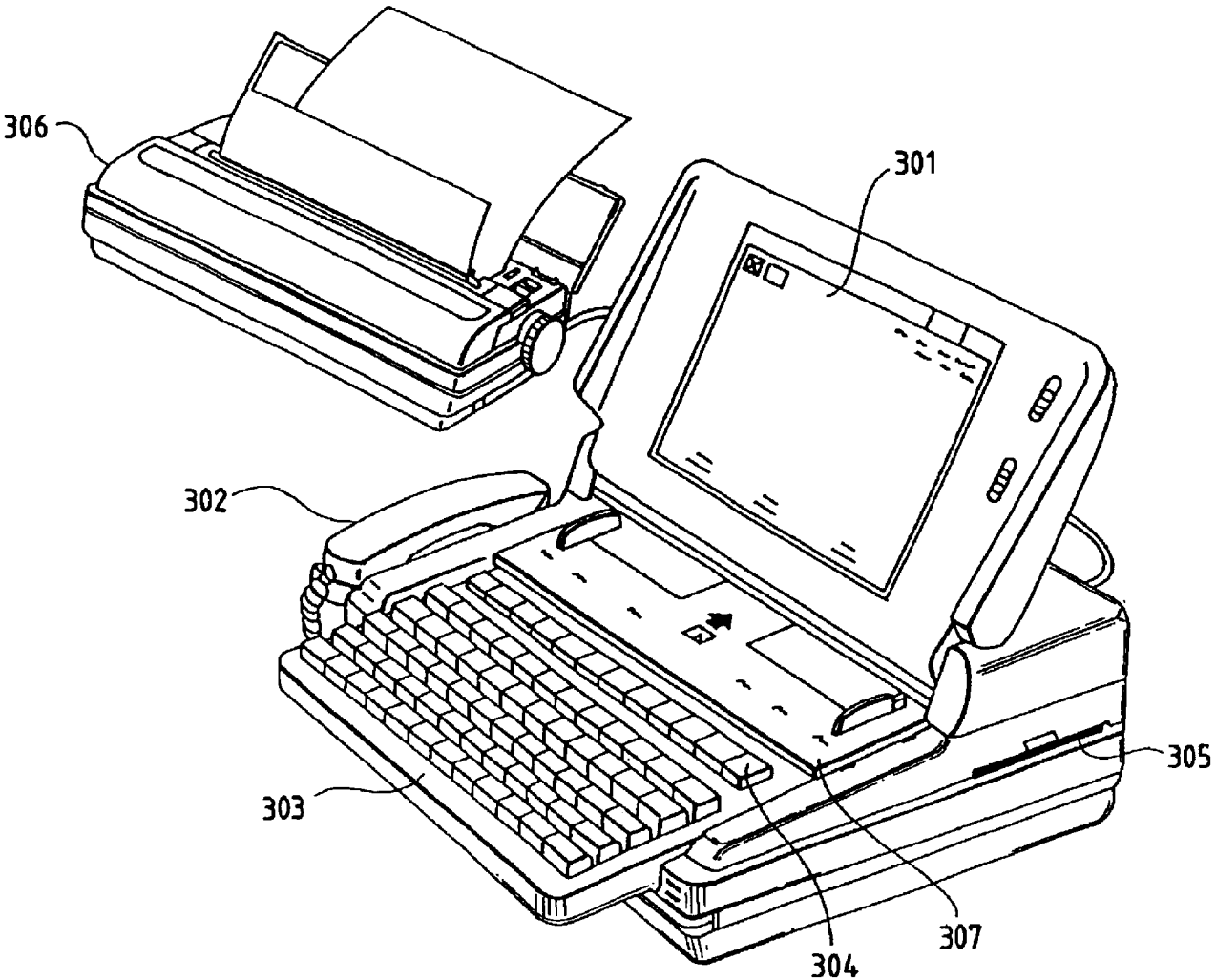
FIG. 38 is an external view of the information processing apparatus.

FIG. 38 is the external view of the information processing apparatus shown in FIG. 37. In the drawing, 301 is a flat panel display which uses an LCD or the like, and it displays various menus, graphic information, character information, etc. The touch panel is provided on the display 301; coordinate inputs can be made or articles can be specified and entered by pressing the surface of the touch panel by fingers or the like. A reference numeral 302 indicates a handset which is used when the apparatus serves as a telephone.

The keyboard 303 is connected removably with the main body through a cord, and it enables diverse types of character information and diverse data to be entered. The keyboard 303 is further provided with function keys 304 or the like. A reference numeral 305 denotes a slit for inserting a floppy disk.

A reference numeral 307 is a paper rest whereon an original to be read by the image reader 207 is placed; the original, which has been read, is ejected from the rear of the apparatus. In facsimile receiving, the printer 307 is used for recording.

A CRT may be used for the aforesaid display 301, however, a flat panel such as a LCD display utilizing a ferroelectric liquid crystal is preferable. This is because a reduced weight can be achieved in addition to a reduced size and thickness. When using the information processing unit described above as a personal computer or a word processor, various information entered through the keyboard 211 is processed by the controller 201 in accordance with predetermined programs and the result is printed as an image on the printer 206 in FIG. 21. When the apparatus serves as a receiving unit of a facsimile apparatus, the facsimile information entered through the facsimile transmitting and receiving unit 208 via a communication line is processed for receiving by the controller 201 in accordance with a specified program and the result is printed as a received image on the printer 206.

Figure 39:
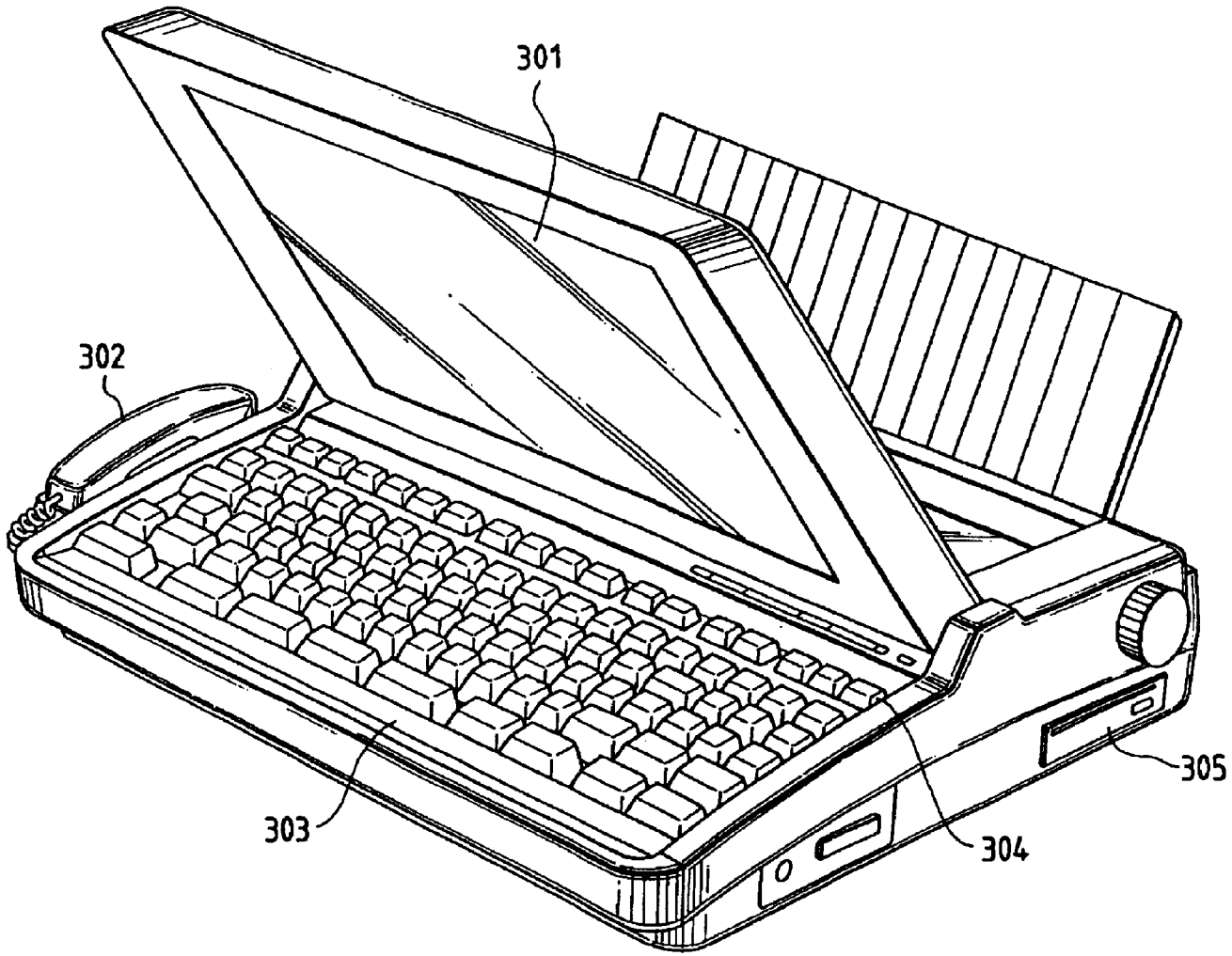
FIG. 39 is an external view showing another example of the information processing apparatus.
Figure 6:
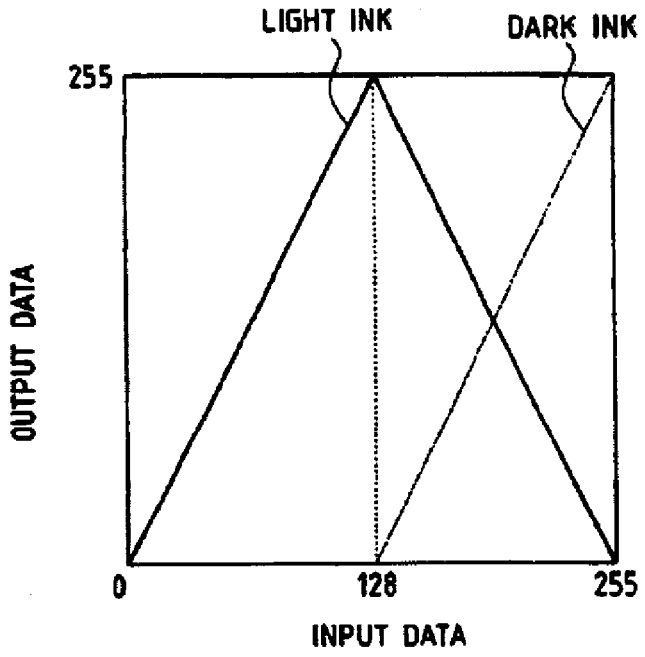
Figure 7:
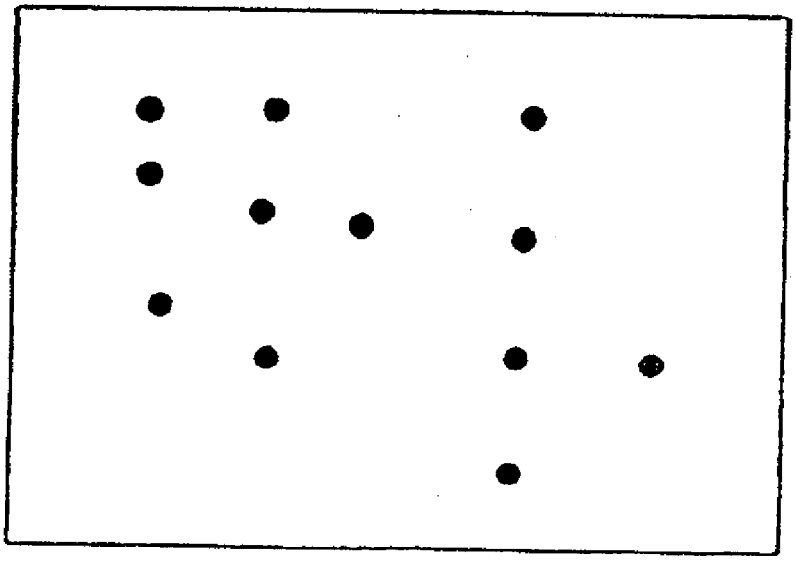

When the apparatus functions as a copying apparatus, an original is read through the image reader 207, and the read original data are printed as a copied image on the printer 206 via the controller 201. When the apparatus serves as a transmitter of the facsimile apparatus, the original data read through the image reader 207 are processed for transmission by the controller 201 in accordance with a specified program, then they are sent onto the communication line via the facsimile transmitting and receiving unit 208. The information processing apparatus described above may be designed to incorporate the printer in the main body as shown in FIG. 39 to enhance the portability. In the drawing, the parts, which have the same functions as those shown in FIG. 38, are given the corresponding reference numerals.

Applying the recording apparatus of the present invention to the multi-functional information processing apparatus discussed above enables high-quality recorded images to be achieved, making it possible to further add to the features of the information processing apparatus.

As discussed above, according to the present invention, in an ink-jet recording apparatus, which is designed to discharge a plurality of inks having different dye densities to form an image, providing at least two types of inks of different dye densities with different penetrability on a recording medium ensures smooth reproduction of medium tone (halftone) gradation with good print quality of black characters and fine lines and also enables recording of a natural image with least likelihood of the occurrence of pseudo contours and changes in the graininess and tone of the recorded image in an ink switching area.

What is claimed is:

1. An ink-jet recording apparatus for forming an image on a recording medium comprising a plurality of ink discharge means and a plurality of ink discharge openings and containing a plurality of inks, wherein the plurality of inks is discharged from the plurality of ink discharge openings by driving the ink discharge means, each ink having a penetrability, a dye density and a color;

said plural ink discharge openings corresponding to a plurality of inks with different dye densities, wherein the penetrabilities of inks having different dye densities and same colors are different from each other and ink having low dye density among the plurality of inks of different dye densities and same colors has more penetrability with respect to the recording medium than ink having high dye density;

and wherein said plurality of inks contain different component ratios of a surfactant, wherein an ink having a relatively high dye density has a lower component ratio of said surfactant than an ink having a relatively low dye density, said apparatus further comprising control means for performing gradational recording by controlling discharge of each of the plurality of inks with different dye densities based on inputted image data, the image data being data representing a density level, wherein said control means controls recording so that recording is performed by mainly using ink having low dye density when the density level represented by the image data is relatively low and recording is performed by mainly using ink having high dye density when the density level represented by the image data is relatively high.

2. The ink-jet recording apparatus according to claim 1, wherein said plural inks consist of the first ink with a relatively high dye density in ink and the second ink with a relatively low dye density in ink in comparison with the first ink, said first ink containing no surfactant in a composition thereof, while said second ink contains said surfactant in a composition thereof.

3. The ink-jet recording apparatus according to claim 1, comprising an image processing means which controls the number of recording dots per unit area of said recording medium in accordance with an inputted image signal to perform gradation recording.

4. The ink-jet recording apparatus according to claim 3, further comprising a distribution means for distributing into recording data for said plural inks with different dye densities in inks in accordance with a gradation indicated by an inputted image signal.

5. The ink-jet recording apparatus according to claim 1, wherein said ink discharge means is means, which discharges an ink by utilizing heat energy and which is provided with an electrothermal energy converting means for generating heat energy to be given to an ink.

6. The ink-jet recording apparatus according to claim 5, wherein said ink discharge means causes an ink to develop a state change by the heat energy applied by said electrothermal energy converting means, thereby discharging the ink through a discharge port according to said state change.

7. The ink-jet recording apparatus according to claim 1, further comprising an image reading means for reading an original image.

8. The ink-jet recording apparatus according to claim 1, further comprising an image transmitting and/or receiving means.

9. The ink-jet recording apparatus according to claim 8, further comprising an image reading means for reading an original image.

10. The ink-jet recording apparatus according to claim 1, further comprising an input means for entering a recording signal.

11. The ink-jet recording apparatus according to claim 10, wherein said input means is a keyboard.

12. An ink-jet recording method for forming an image on a recording medium comprising the steps of:

providing a plurality of inks, each having a penetrability, a dye density and a color;

providing a recording medium;

providing a plurality of ink discharge openings and a plurality of ink discharge means;

discharging onto the recording medium the plurality of inks from the plurality of ink discharge openings by driving the ink discharge means;

said plurality of ink discharge openings corresponding to a plurality of inks with different dye densities, wherein the penetrabilities of inks having different dye densities and same colors are different from each other, and ink having low dye density among the plurality of inks of different dye densities and same colors has more penetrability with respect to the recording medium than ink having high dye density;

wherein said plurality of inks contain different component ratios of a surfactant, wherein an ink having a relatively high dye density has a lower component ratio of said surfactant than an ink having a relatively low dye density;

performing gradational recording by controlling discharge of each of the plurality of inks with different dye densities based on inputted image data, the image data being data representing a density level, wherein discharge is controlled so that recording is performed by mainly using ink having low dye density when the density level represented by the image data is relatively low and recording is performed by mainly using ink having high dye density when the density level represented by the image data is relatively high.

13. The ink-jet recording method according to claim 12, wherein said plural inks consist of the first ink with a relatively high dye density in ink and the second ink with a relatively low dye density in ink in comparison with the first ink, said first ink containing no surfactant in a composition thereof, while said second ink contains said surfactant in a composition thereof.

14. The ink-jet recording method according to claim 12, comprising an image processing step wherein the number of recording dots per unit area of said recording medium is controlled in accordance with an inputted image signal to perform gradation recording.

15. The ink-jet recording method according to claim 14, further comprising a distribution step distributing into recording data for said plural inks with different dye densities in inks in accordance with a gradation indicated by an inputted image signal.

16. The ink-jet recording method according to claim 12, wherein said ink discharge means is a means, which discharges an ink by utilizing heat energy and which causes the ink to develop a state change by heat energy and to be discharged through a port according to said state change.

17. An ink-jet recording apparatus, comprising a recording head equipped with a plurality of ink discharge means, and a plurality of discharge ports and containing a plurality of inks, wherein the plural discharge ports of said recording head are comprised of a plurality of discharge port trains corresponding to the plurality of inks, wherein the plurality of inks is discharged onto a recording medium to form an image, each of the plurality of inks having a penetrability, a color and a different dye density, wherein the penetrabilities of inks having different dye densities and same colors are different from each other and ink having low dye density among the plurality of inks of different dye densities and same colors has more penetrability with respect to the recording medium than having high dye density;

and wherein said plurality of inks contain different component ratios of a surfactant, wherein an ink having a relatively high dye density has a lower component ratio of said surfactant than an ink having a relatively low dye density, said apparatus further comprising control means for performing gradational recording by controlling discharge of each of the plurality of inks with different dye densities based on inputted image data, the image data being data representing a density level, wherein said control means controls recording so that recording is performed by mainly using ink having low dye density when the density level represented by the image data is relatively low and recording is performed by mainly using ink having high dye density when the density level represented by the image data is relatively high.

18. The ink-jet recording apparatus according to claim 17, comprising a plurality of said recording heads, each of said plural recording heads discharging ink of a different color.

19. The ink-jet recording apparatus according to claim 17, wherein said plural inks with different dye densities in ink consist of the first ink with a relatively high dye density in ink and the second ink with a relatively low dye density in ink in comparison with the first ink, said first ink containing no surfactant in a composition thereof, while said second ink contains said surfactant in a composition thereof.

20. The ink-jet recording apparatus according to claim 17, comprising an image processing means which controls the number of recording dots per unit area of said recording medium in accordance with an inputted image signal to perform gradation recording.

21. The inkjet recording apparatus according to claim 20, further comprising a distribution means which divides entered data as recording data for said plural inks with different dye densities in inks in accordance with a gradation indicated by an inputted image signal.

22. The ink-jet recording apparatus according to claim 17, wherein said ink discharge means is a means, which discharges an ink by utilizing heat energy and which is provided with an electrothermal energy converting means for generating heat energy to be given to an ink.

23. The ink-jet recording apparatus according to claim 2, wherein said ink discharge means causes an ink to develop a state change by the heat energy applied by said electrothermal energy converting means, thereby discharging the ink through a discharge port according to said state change.

24. An ink-jet recording apparatus, comprising a plurality of recording heads equipped with a plurality of ink discharge means and a plurality of discharge ports and containing a plurality of inks, wherein said plural recording heads corresponds to the plurality of inks, each ink having a penetrability, a color and a different dye density, wherein the plurality of inks is discharged onto a recording medium to form an image, and wherein the penetrabilities of inks having different dye densities and same colors are different from each other and ink having low dye density among the plurality of inks of different dye densities and same colon has more penetrability with respect to the recording medium than ink having high dye density;

and wherein said plurality of inks contain different component ratios of a surfactant, wherein an ink having a relatively high dye density has a lower component ratio of said surfactant than an ink having a relatively low dye density, said apparatus further comprising control means for performing gradational recording by controlling discharge of each of the plurality of inks with different dye densities based on inputted image data, the image data being data representing a density level, wherein said control means controls recording so that recording is performed by mainly using ink having low dye density when the density level represented by the image data is relatively low and recording is performed by mainly using ink having high dye density when the density level represented by the image data is relatively high.

25. The ink-jet recording apparatus according to claim 24, wherein said plural inks with different dye densities in ink consist of the first ink with a relatively high dye density in ink and the second ink with a relatively low dye density in ink in comparison with the first ink, said first ink containing no surfactant in a composition thereof, while said second ink contains said surfactant in a composition thereof.

26. The ink-jet recording apparatus according to claim 24, wherein said ink discharge means is a means, which discharges an ink by utilizing heat energy and which is provided with an electrothermal energy converting means for generating heat energy to be given to an ink.

27. The ink-jet recording apparatus according to claim 26, wherein said ink discharge means causes an ink to develop a state change by the heat energy applied by said electrothermal energy converting means, thereby discharging the ink through a discharge port according to said state change.

28. An ink-jet recording apparatus which forms an image on a recording medium by using a plurality of ink discharge means discharging a plurality of inks, wherein said plural ink discharge means correspond to the plurality of inks, the plurality of inks are inks having different dye densities with respect to a plurality of colors, the plurality of inks are contained in a plurality of ink containers and each of the plurality of ink containers corresponds to a different color of ink, each of the ink containers containing a plurality of inks having different dye densities of a same color series; and wherein said plural inks having different dye densities in ink have different penetrabilities on a recording medium.

29. The ink-jet recording apparatus according to claim 28, wherein said plural inks having different dye densities in ink are held in said ink containers, the volume of each of said inks being different.

30. The ink-jet recording apparatus according to claim 28, wherein said plural inks with different dye densities in ink have different component ratios of surfactant in ink.

31. The ink-jet recording apparatus according to claim 30, wherein, among said plural inks, an ink having a relatively high dye density in ink has a lower component ratio of said surfactant than an ink having a relatively low dye density.

32. The ink-jet recording apparatus according to claim 30, wherein said plural inks with different dye densities in ink consists of the first ink with a relatively high dye density in ink and the second ink with a relatively low dye density in ink in comparison with the first ink, said first ink containing no surfactant in a composition thereof, while said second ink containing said surfactant in a composition thereof.

33. The ink-jet recording apparatus according to claim 30, comprising an image processing means which controls the number of recording dots per unit area of said recording medium in accordance with an inputted image signal to perform gradation recording.

34. The ink-jet recording apparatus according to claim 33, further comprising a distribution means which divides entered data as recording data for said plural inks with different dye densities in inks in accordance with a gradation indicated by an inputted image signal.

35. The ink-jet recording apparatus according to claim 30, wherein said ink discharge means is a means, which discharges an ink by utilizing heat energy and which is provided with an electrothermal energy converting means for generating heat energy to be given to an ink.

36. The ink-jet recording apparatus according to claim 35, wherein said ink discharge means causes an ink to develop a state change by the heat energy applied by said electrothermal energy converting means, thereby discharging the ink through a discharge port according to said state change.

37. The ink-jet recording apparatus according to claim 30, further comprising an image reading means for reading an original image.

38. The ink-jet recording apparatus according to claim 30, further comprising an image transmitting and/or receiving means.

39. The ink-jet recording apparatus according to claim 38, further comprising an image reading means for reading an original image.

40. The ink-jet recording apparatus according to claim 30, further comprising an input means for entering a recording signal.

41. The ink-jet recording apparatus according to claim 40, wherein said input means is a keyboard.

42. An ink-jet recording apparatus, containing a plurality of inks and comprising a plurality of recording heads equipped with a plurality of ink discharge means, which discharge ink through discharge ports, and forming an image on a recording medium by discharging the ink through a plurality of discharge ports of said recording heads, wherein said plural recording heads correspond to the plurality of inks, the plurality of inks are inks having different dye densities with respect to a plurality of colors, the plurality of inks are contained in a plurality of ink containers and each of the plurality of ink containers corresponds to a different color of ink, each of the ink containers containing a plurality of inks having different dye densities of a same color series; and wherein said plural inks having different dye densities in ink have different penetrabilities on a recording medium.

43. The ink-jet recording apparatus according to claim 42, wherein said plural inks having different dye densities in ink are held in said ink containers the volume of each of said inks being different.

44. The ink-jet recording apparatus according to claim 42, wherein the plural discharge ports of said recording heads comprise a plurality of discharge port trains corresponding to a plurality of different color materials, and each of said plural recording heads is capable of discharging a plurality of the same color material.

45. The ink-jet recording apparatus according to claim 42, comprising an image processing means which controls the number of recording dots per unit area of said recording medium in accordance with an inputted image signal to perform gradation recording.

46. The ink-jet recording apparatus according to claim 45, further comprising a distribution means which divides entered data as recording data for said plural inks with different dye densities in inks in accordance with a gradation indicated by an inputted image signal.

47. The ink-jet recording apparatus according to claim 42, wherein said ink discharge means is a means, which discharges an ink by utilizing heat energy and which is provided with an electrothermal energy converting means for generating heat energy to be given to an ink.

48. The ink-jet recording apparatus according to claim 47, wherein said ink discharge means causes an ink to develop a state change by the heat energy applied by said electrothermal energy converting means, thereby discharging the ink through a discharge port according to said state change.

49. An ink-jet recording apparatus containing a plurality of inks and comprising a plurality of recording heads equipped with a plurality of ink discharge means for discharging inks and forming an image on a recording medium by discharging the inks from a plurality of discharge ports of said recording heads, wherein said plural recording heads correspond to the plurality of inks having different color materials, the plural discharge ports of said recording heads comprising a plurality of discharge port trains corresponding to the plural inks having different dye densities, the plurality of inks are inks having different dye densities with respect to a plurality of colors, the plurality of inks are contained in a plurality of ink containers and each of the plurality of ink containers corresponds to a different color of ink, each of the ink containers containing a plurality of inks having different dye densities of a same color series; and wherein said plural inks having different dye densities in ink have different penetrabilities on a recording medium.

50. An ink-jet recording apparatus for recording by discharging a plurality of inks having different densities of a same color series for use with an ink-jet head for discharging ink, comprising:

a recording control means for recording by discharging a plurality of inks having different densities of a same color series by said ink-jet head, wherein the recording control means controls discharge of each of said plurality of inks in accordance with a level represented by input image data, wherein each of said plurality of inks having different densities of the same series of color contains a different amount of surfactant for enhancing penetrability with respect to a recording medium, such that an ink having a low density contains a greater amount of said surfactant than an ink having a high density, and wherein said recording control means controls recording with a plurality of inks having different densities so that recording is performed by mainly using ink having low density when the image data is a low level and recording is performed by mainly using ink having high density when the image data is a high level.

51. An ink-jet recording apparatus according to claim 50, wherein said plurality of inks consists of a first ink with a relatively high dye density and a second ink with a relatively low dye density in comparison with the first ink, wherein said first ink contains no surfactant and said second ink contains said surfactant.

52. An ink-jet recording apparatus according to claim 50, comprising an image processing means that controls the number of recording dots per unit area of said recording medium in accordance with an inputted image signal to perform gradation recording.

53. An ink-jet recording apparatus according to claim 52, further comprising a distribution means for distributing into recording data for said plurality of inks with different dye densities in accordance with a gradation indication by an inputted image signal.

54. An ink-jet recording apparatus according to claim 50, wherein said ink is discharged by an ink discharge means that discharges an ink by utilizing heat energy and which is provided with an electrothermal energy converting means for generating heat energy to be given to an ink.

55. An ink-jet recording apparatus according to claim 54, wherein said ink discharge means causes an ink to develop a state change by the heat energy applied by said electrothermal energy converting means, thereby discharging the ink through a discharge port according to said state change.

56. An ink-jet recording apparatus according to claim 50, further comprising an image reading means for reading an original image.

57. An ink-jet recording apparatus according to claim 50, further comprising an image transmitting and/or receiving means.

58. An ink-jet recording apparatus according to claim 57, further comprising an image reading means for reading an original image.

59. An ink-jet recording apparatus according to claim 50, further comprising an input means for entering a recording signal.

60. An ink-jet recording apparatus according to claim 59, wherein said input means is a keyboard.

61. An ink-jet recording method for recording by discharging a plurality of inks having different densities of a same color series for use with an ink-jet head for discharging ink, comprising the steps of:

inputting image data representing a density level;

generating data for discharging ink, corresponding to each of a plurality of inks having different densities of a same color series in accordance with said image data; and recording by discharging ink based on said generated data, wherein each of said plurality of inks having different densities of the same color series contains a different amount of surfactant for enhancing penetrability with respect to a recording medium, such that an ink having a low density contains a greater amount of said surfactant than an ink having a high density, and wherein recording is performed with a plurality of inks and by mainly using ink having low density when the image data is a low level and mainly using ink having high density when the image data is a high level.

62. An ink-jet recording method according to claim 61, wherein said plurality of inks consists of a first ink with a relatively high dye density and a second ink with a relatively low dye density in comparison with the first ink, wherein said first ink contains no surfactant and said second ink contains said surfactant.

63. An ink-jet recording method according to claim 61, comprising an image processing step that controls the number of recording dots per unit area of said recording medium in accordance with an inputted image signal to perform gradation recording.

64. An ink-jet recording method according to claim 63, further comprising a distribution step for distributing into recording data for said plurality of inks with different dye densities in accordance with a gradation indication by an inputted image signal.

65. An ink-jet recording method according to claim 61, wherein said ink is discharged by an ink discharge step that discharges an ink by utilizing heat energy and includes an electrothermal energy converting sub-step for generating heat energy to be given to an ink.

66. An ink-jet recording method according to claim 65, wherein said ink discharge step causes an ink to develop a state change by the heat energy applied by said electrothermal energy converting sub-step, thereby discharging the ink through a discharge port according to said state change.

67. An ink-jet recording method according to claim 61, further comprising an image reading step for reading an original image.

68. An ink-jet recording method according to claim 61, further comprising an image transmitting and/or receiving step.

69. An ink-jet recording method according to claim 68, further comprising an image reading step for reading an original image.

70. An ink-jet recording method according to claim 61, further comprising an input step for entering a recording signal.

71. An ink-jet recording method according to claim 70, wherein said input step utilizes a keyboard.

* * * * *

UNITED STATES PATENT AND TRADEMARK OFFICE

CERTIFICATE OF CORRECTION

PATENT NO. : 6,793,308 B2
DATED : September 21, 2004
INVENTOR(S) : Sugimoto et al.

It is certified that error appears in the above-identified patent and that said Letters Patent is hereby corrected as shown below:

Title page,
Item [*] Notice, insert -- This patent issued on a continued prosecution application filed under 37 CFR 1.53(d), and is subject to the twenty year patent term provisions of 35 U. S.C. 154(a)(2). --
Item [56], References Cited, FOREIGN PATENT DOCUMENTS,
"59123670" should read -- 59-123670 --, and "59138461" should read -- 59-138461 --.

Column 1,
Line 33, "device." should read -- device is provided. --.

Column 2,
Line 20, "is" should read -- are --.
Line 32, "however," should be deleted.
Line 38, "limitation" should read -- limitations --.
Line 40, "posed" should read -- pose --.

Column 3,
Line 29, "min" should read -- in --.

Column 4,
Line 34, "use" should read -- used --.

Column 7,
Line 8, "port 2," should read -- port 2. --
Line 9, "is disposed." should be deleted.

Column 9,
Line 30, "with" should read -- having --.

Column 11,
Line 2, "In" should read -- On --.
Line 39, "aceton" should read -- acetone --.

Column 12,
Line 7, "charge" should read -- discharge --.

UNITED STATES PATENT AND TRADEMARK OFFICE

CERTIFICATE OF CORRECTION

PATENT NO. : 6,793,308 B2
DATED : September 21, 2004
INVENTOR(S) : Sugimoto et al.

It is certified that error appears in the above-identified patent and that said Letters Patent is hereby corrected as shown below:

Column 12,
Line 7, “charge” should read -- discharge --.

Column 13,
Line 19, “pass” should read -- passes --.
Line 21, “seal” should read -- seals --.

Column 23,
Line 18, “an” should be deleted.
Line 34, “are” should read -- is --.
Line 36, “inks are” should read -- inks, --.
Line 67, “it” should read -- they --.

Column 24
Line 2, “an” should be deleted.
Line 26, “to cause” should read -- causing --.

Column 26,
Line 28, “is” should be deleted.

Column 28,
Lines 61 and 67, “density;” should read -- density, --.

Column 29,
Line 31, “a port” should read -- a discharge port --.
Line 44, “than having” should read -- than ink having --.

UNITED STATES PATENT AND TRADEMARK OFFICE

CERTIFICATE OF CORRECTION

PATENT NO. : 6,793,308 B2
DATED : September 21, 2004
INVENTOR(S) : Sugimoto et al.

It is certified that error appears in the above-identified patent and that said Letters Patent is hereby corrected as shown below:

Column 30,
Line 21, “claim 2,” should read -- claim 22, --.
Line 30, “responds” shoud read -- respond --.
Line 36, “colon” should read -- colors --.

Column 31,
Line 31, “consists” should read -- consist --.
Line 35, “containing” should read -- contains --.

Signed and Sealed this

First Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,793,308 B2
DATED : September 21, 2004
INVENTOR(S) : Sugimoto et al.

It is certified that error appears in the above-identified patent and that said Letters Patent is hereby corrected as shown below:

Delete drawing sheet 5, consisting of figures 6 & 7, and substitute therefore, drawing sheet 5, consisting of figures 6 & 7. (as shown on the attached sheet)

Signed and Sealed this

Twenty-sixth Day of July, 2005

JON W. DUDAS
*Director of the United States Patent and Trademark Office*